US010035690B2

(12) United States Patent
Kelley et al.

(10) Patent No.: US 10,035,690 B2
(45) Date of Patent: Jul. 31, 2018

(54) DEFORMABLE CONTAINER WITH HOOP RINGS

(75) Inventors: Paul V. Kelley, Wrightsville, PA (US); Scott E. Bysick, Elizabethtown, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 0 days.

(21) Appl. No.: 13/184,368

(22) Filed: Jul. 15, 2011

(65) Prior Publication Data

US 2011/0266293 A1 Nov. 3, 2011

Related U.S. Application Data

(63) Continuation of application No. 12/651,461, filed on Jan. 2, 2010, which is a continuation of application
(Continued)

(51) Int. Cl.
*B65D 90/02* (2006.01)
*B65D 6/28* (2006.01)
(Continued)

(52) U.S. Cl.
CPC ..... *B67C 3/045* (2013.01); *B65B 61/24* (2013.01); *B65D 1/0261* (2013.01); *B65B 61/28* (2013.01);
(Continued)

(58) Field of Classification Search
CPC ..... B65D 1/0223; B65D 79/005; B65D 2501/0081; B65D 2501/0036
(Continued)

(56) References Cited

U.S. PATENT DOCUMENTS 1,499,239 A 6/1924 Malmquist
D110,624 S 7/1938 Mekeel, Jr.
(Continued)

FOREIGN PATENT DOCUMENTS

AU 2002257159 B2 4/2003
CA 2077717 A1 3/1993
(Continued)

OTHER PUBLICATIONS

Examination Report dated Jul. 25, 2012 in New Zealand Patent Application No. 593486.
(Continued)

*Primary Examiner* — Andrew T Kirsch
(74) *Attorney, Agent, or Firm* — Baker Botts L.L.P.

(57) ABSTRACT

Method and system for handling a plurality of hot-filled and capped containers having temporary deformations or distortions caused by vacuums induced in the containers. For each container, temporary deformations are confined or directed to a particular portion of the container. Annular hoop rings can be provided to confine the temporary deformations to a smooth sidewall portion of the container between the annular hoop rings. Alternatively, one or more supplemental vacuum panels can be provided to confine or direct the temporary deformation thereto. The annular hoop rings and the one or more supplemental vacuum panels can provide for substantially stable touch points for the container. The containers are conveyed with temporary deformations such that substantially stable contact points of each container are in contact with corresponding substantially stable contact points of other containers. After the conveying, a moveable element in a bottom end of each container is activated substantially permanently to remove the vacuum in the container.

11 Claims, 9 Drawing Sheets

Related U.S. Application Data

No. 12/349,268, filed on Jan. 6, 2009, now Pat. No. 7,926,243.

(51) Int. Cl.

| | |
|---|---|
| ***B65D 8/04*** | (2006.01) |
| ***B65D 8/06*** | (2006.01) |
| ***B65D 6/00*** | (2006.01) |
| ***B65D 8/18*** | (2006.01) |
| ***B65D 1/02*** | (2006.01) |
| ***B65D 79/00*** | (2006.01) |
| ***B67C 3/04*** | (2006.01) |
| ***B65B 61/24*** | (2006.01) |
| *B65B 61/28* | (2006.01) |
| *B67C 3/22* | (2006.01) |

(52) U.S. Cl.
CPC ..... *B65D 2501/0036* (2013.01); *B67C 2003/226* (2013.01)

(58) Field of Classification Search
USPC ..... 215/381, 382, 383; 220/608, 609, 675, 220/669
See application file for complete search history.

(56) References Cited

U.S. PATENT DOCUMENTS 2,124,959 A 7/1938 Vogel
2,142,257 A 1/1939 Saeta
2,378,324 A 6/1945 Ray et al.
2,880,902 A 4/1959 Owsen
2,960,248 A 11/1960 Kuhlman
2,971,671 A 2/1961 Shakman
2,982,440 A * 5/1961 Harrison ..... 220/609
3,043,461 A * 7/1962 Glassco ..... 215/375
3,081,002 A 3/1963 Tauschinski et al.
3,090,478 A 5/1963 Stanley
3,142,371 A 7/1964 Rice et al.
3,174,655 A 3/1965 Hurschman
3,201,111 A 8/1965 Afton
3,301,293 A 1/1967 Santellli
3,325,031 A 6/1967 Singier
3,397,724 A 8/1968 Bolen et al.
3,409,167 A 11/1968 Blanchard
3,417,893 A 12/1968 Lieberman
3,426,939 A 2/1969 Young
3,441,982 A 5/1969 Tsukahara et al.
3,468,443 A 9/1969 Marcus
3,483,908 A 12/1969 Donovan
3,485,355 A 12/1969 Stewart
3,693,828 A 9/1972 Kneusel et al.
3,704,140 A 11/1972 Petit et al.
3,727,783 A 4/1973 Carmichael
3,791,508 A 2/1974 Osborne et al.
3,819,789 A 6/1974 Parker
3,904,069 A * 9/1975 Toukmanian ..... 220/609
3,918,920 A 11/1975 Barber
3,935,955 A 2/1976 Das
3,941,237 A 3/1976 MacGregor, Jr.
3,942,673 A 3/1976 Lyu et al.
3,949,033 A 4/1976 Uhlig
3,956,441 A 5/1976 Uhlig
4,035,455 A 7/1977 Rosencranz et al.
4,036,926 A 7/1977 Chang
4,037,752 A 7/1977 Dulmaine et al.
4,117,062 A 9/1978 Uhlig
4,123,217 A 10/1978 Fischer et al.
4,125,632 A 11/1978 Vosti et al.
4,134,510 A 1/1979 Chang
4,158,624 A 6/1979 Ford et al.
4,170,622 A 10/1979 Uhlig
4,170,662 A 10/1979 Uhlig et al.
4,174,782 A 11/1979 Obsomer
4,177,239 A 12/1979 Gittner et al.
4,219,137 A 8/1980 Hutchens
4,231,483 A 11/1980 Dechenne et al.
4,247,012 A 1/1981 Alberghini
4,301,933 A 11/1981 Yoshino et al.
4,318,489 A 3/1982 Snyder et al.
4,318,882 A 3/1982 Agrawal et al.
4,338,765 A 7/1982 Ohmori et al.
4,355,728 A 10/1982 Yoshino et al.
4,377,191 A 3/1983 Yamaguchi
4,378,328 A 3/1983 Przytulla
4,381,061 A 4/1983 Cerny et al.
4,386,701 A 6/1983 Galer
4,436,216 A 3/1984 Chang
4,444,308 A 4/1984 MacEwen
4,450,878 A 5/1984 Takada et al.
4,465,199 A 8/1984 Aoki
4,495,974 A 1/1985 Pohorski
4,497,621 A 2/1985 Kudert et al.
4,497,855 A 2/1985 Agrawal et al.
4,525,401 A 6/1985 Pocock et al.
4,542,029 A 9/1985 Caner et al.
4,547,333 A 10/1985 Takada
4,585,158 A 4/1986 Wardlaw, III
D269,158 S 5/1986 Gaunt et al.
4,610,366 A * 9/1986 Estes et al. ..... 426/106
4,628,669 A 12/1986 Herron et al.
4,642,968 A 2/1987 McHenry et al.
4,645,078 A 2/1987 Reyner
4,667,454 A 5/1987 McHenry et al.
4,684,025 A 8/1987 Copland et al.
4,685,273 A 8/1987 Caner et al.
D292,378 S 10/1987 Brandt et al.
4,701,121 A 10/1987 Jakobsen et al.
4,723,661 A 2/1988 Hoppmann et al.
4,724,855 A 2/1988 Jackson
4,725,464 A 2/1988 Collette
4,747,507 A 5/1988 Fitzgerald et al.
4,749,092 A 6/1988 Sugiura et al.
4,769,206 A 9/1988 Reymann et al.
4,773,458 A 9/1988 Touzani
4,785,949 A 11/1988 Krishnakumar et al.
4,785,950 A 11/1988 Miller et al.
4,807,424 A 2/1989 Robinson et al.
4,813,556 A 3/1989 Lawrence
4,831,050 A 5/1989 Bettle
4,836,398 A * 6/1989 Leftault et al. ..... 220/609
4,840,289 A 6/1989 Fait et al.
4,850,493 A 7/1989 Howard, Jr.
4,850,494 A 7/1989 Howard, Jr.
4,865,206 A 9/1989 Behm et al.
4,867,323 A 9/1989 Powers
4,880,129 A 11/1989 McHenry et al.
4,887,730 A 12/1989 Touzani
4,892,205 A 1/1990 Powers et al.
4,896,205 A 1/1990 Weber
4,921,147 A 5/1990 Poirier
4,927,679 A 5/1990 Beck
4,962,863 A 10/1990 Wendling et al.
4,967,538 A 11/1990 Leftault et al.
4,978,015 A 12/1990 Walker
4,997,692 A 3/1991 Yoshino
5,004,109 A 4/1991 Bartlet et al.
5,005,716 A 4/1991 Eberle
5,014,868 A 5/1991 Wittig et al.
5,020,306 A 6/1991 Raudat
5,020,691 A 6/1991 Nye
5,024,340 A 6/1991 Alberghini et al.
5,033,254 A 7/1991 Zenger
5,054,632 A 10/1991 Alberghini et al.
5,060,453 A * 10/1991 Alberghini et al. ..... 53/440
5,067,622 A * 11/1991 Garver et al. ..... 215/381
5,090,180 A 2/1992 Sorensen
5,092,474 A 3/1992 Leigner
5,122,327 A 6/1992 Spina et al.
5,133,468 A 7/1992 Brunson et al.
5,141,121 A 8/1992 Brown et al.
5,178,290 A 1/1993 Ota et al.
5,199,587 A 4/1993 Ota et al.

(56) References Cited

U.S. PATENT DOCUMENTS 5,199,588 A 4/1993 Hayashi
5,201,438 A 4/1993 Norwood
5,217,737 A * 6/1993 Gygax et al. ..... 426/111
5,234,126 A 8/1993 Jonas et al.
5,244,106 A 9/1993 Takacs
5,251,424 A 10/1993 Zenger et al.
5,255,889 A 10/1993 Collette et al.
5,261,544 A 11/1993 Weaver, Jr.
5,279,433 A 1/1994 Krishnakumar et al.
5,281,387 A 1/1994 Collette et al.
5,310,043 A 5/1994 Alcorn
5,333,761 A 8/1994 Davis et al.
5,337,924 A 8/1994 Dickie
5,341,946 A 8/1994 Valliencourt et al.
5,389,332 A 2/1995 Amari et al.
5,392,937 A 2/1995 Prevot et al.
5,405,015 A 4/1995 Bhatia et al.
5,411,699 A 5/1995 Collette et al.
3,198,861 A 8/1995 Marvel
5,454,481 A 10/1995 Hsu
5,472,105 A 12/1995 Krishnakumar et al.
5,472,181 A 12/1995 Lowell
RE35,140 E 1/1996 Powers, Jr.
5,484,052 A 1/1996 Pawloski et al.
5,492,245 A 2/1996 Kalkanis
5,503,283 A 4/1996 Semersky
5,543,107 A 8/1996 Malik et al.
5,593,063 A 1/1997 Claydon et al.
5,598,941 A 2/1997 Semersky et al.
5,632,397 A 5/1997 Fandeux et al.
5,642,826 A 7/1997 Melrose
5,672,730 A 9/1997 Cottman
5,687,874 A 11/1997 Omori et al.
5,690,244 A * 11/1997 Darr ..... 215/382
5,697,489 A 12/1997 Deonarine et al.
5,704,504 A 1/1998 Bueno
5,713,480 A 2/1998 Petre et al.
5,718,030 A 2/1998 Langmack et al.
5,730,914 A 3/1998 Ruppman, Sr.
5,735,420 A 4/1998 Nakamaki et al.
5,737,827 A 4/1998 Kuse et al.
5,758,802 A 6/1998 Wallays
5,762,221 A 6/1998 Tobias et al.
5,780,130 A 7/1998 Hansen et al.
5,785,197 A 7/1998 Slat
5,819,507 A 10/1998 Kaneko et al.
5,829,614 A 11/1998 Collette et al.
5,860,556 A 1/1999 Robbins, III
5,887,739 A 3/1999 Prevot et al.
5,888,598 A 3/1999 Brewster et al.
5,897,090 A 4/1999 Smith et al.
5,906,286 A 5/1999 Matsuno et al.
5,908,128 A 6/1999 Krishnakumar et al.
D415,030 S 10/1999 Searle et al.
5,971,184 A 10/1999 Krishnakumar et al.
5,976,653 A 11/1999 Collette et al.
5,989,661 A 11/1999 Krishnakumar et al.
RE36,639 E 4/2000 Okhai
6,045,001 A 4/2000 Spul
6,051,295 A 4/2000 Schloss et al.
6,063,325 A 5/2000 Nahill et al.
6,065,624 A 5/2000 Steinke
6,068,110 A 5/2000 Kumakiri et al.
6,074,596 A 6/2000 Jacquet
6,077,554 A * 6/2000 Wiemann et al. ..... 426/397
6,090,334 A 7/2000 Matsuno et al.
6,105,815 A 8/2000 Mazda
6,113,377 A 9/2000 Clark
6,176,382 B1 1/2001 Bazlur
6,209,710 B1 4/2001 Mueller et al.
6,213,325 B1 4/2001 Cheng et al.
6,217,818 B1 4/2001 Collette et al.
6,228,317 B1 5/2001 Cargile
6,230,912 B1 * 5/2001 Rashid ..... 215/383
6,248,413 B1 6/2001 Barel et al.
6,253,809 B1 7/2001 Paradies
6,277,321 B1 8/2001 Vailliencourt et al.
6,298,638 B1 8/2001 Vailliencourt et al.
6,354,427 B1 3/2002 Pickel et al.
6,375,025 B1 4/2002 Mooney
6,390,316 B1 5/2002 Mooney
6,413,466 B1 7/2002 Boyd et al.
6,439,413 B1 8/2002 Prevot et al.
6,467,639 B2 10/2002 Mooney
6,485,669 B1 11/2002 Boyd et al.
6,502,369 B1 1/2003 Andison
6,514,451 B1 2/2003 Boyd et al.
6,585,124 B2 7/2003 Boyd et al.
6,595,380 B2 7/2003 Silvers
6,612,451 B2 9/2003 Tobias et al.
6,635,217 B1 10/2003 Britton
6,662,960 B2 * 12/2003 Hong et al. ..... 215/381
6,676,883 B2 1/2004 Hutchinson et al.
6,749,780 B2 6/2004 Tobias
6,763,968 B1 7/2004 Boyd et al.
6,769,561 B2 8/2004 Futral et al.
6,779,673 B2 8/2004 Melrose et al.
6,923,334 B2 8/2005 Melrose et al.
6,942,116 B2 * 9/2005 Lisch et al. ..... 215/373
6,983,858 B2 * 1/2006 Slat et al. ..... 215/373
7,051,073 B1 5/2006 Dutta
7,051,889 B2 5/2006 Boukobza
D522,368 S 6/2006 Darr et al.
7,073,675 B2 7/2006 Trude
7,077,279 B2 7/2006 Melrose
7,080,747 B2 7/2006 Lane et al.
7,137,520 B1 11/2006 Melrose
7,140,505 B2 11/2006 Roubal et al.
7,150,372 B2 * 12/2006 Lisch et al. ..... 215/373
7,159,374 B2 1/2007 Abercrombie et al.
7,350,657 B2 4/2008 Eaton et al.
7,416,089 B2 8/2008 Kraft et al.
7,451,886 B2 11/2008 Lisch et al.
7,543,713 B2 6/2009 Trude et al.
7,552,834 B2 6/2009 Tanaka et al.
7,574,846 B2 8/2009 Sheets et al.
7,726,106 B2 6/2010 Kelley et al.
7,735,304 B2 6/2010 Kelley et al.
7,748,551 B2 7/2010 Gatewood et al.
7,799,264 B2 9/2010 Trude
7,900,425 B2 3/2011 Bysick et al.
7,926,243 B2 4/2011 Kelley et al.
D637,913 S 5/2011 Schlies et al.
D641,244 S * 7/2011 Bysick et al. ..... D9/502
7,980,404 B2 7/2011 Trude et al.
8,011,166 B2 9/2011 Sheets et al.
8,017,065 B2 9/2011 Trude et al.
8,028,498 B2 10/2011 Melrose
8,075,833 B2 12/2011 Kelley
8,096,098 B2 1/2012 Kelley et al.
8,162,655 B2 4/2012 Trude et al.
8,171,701 B2 5/2012 Kelley et al.
8,235,704 B2 8/2012 Kelley
8,323,555 B2 12/2012 Trude et al.
2001/0035391 A 1/2001 Young et al.
2002/0074336 A1 6/2002 Silvers
2002/0096486 A1 7/2002 Takao Lizuka et al.
2002/0153343 A1 * 10/2002 Tobias et al. ..... 215/375
2002/0158038 A1 10/2002 Heisel et al.
2003/0015491 A1 1/2003 Melrose et al.
2003/0186006 A1 10/2003 Schmidt et al.
2003/0196926 A1 10/2003 Tobias et al.
2003/0217947 A1 11/2003 Ishikawa et al.
2004/0000533 A1 1/2004 Kamineni et al.
2004/0016716 A1 1/2004 Melrose et al.
2004/0074864 A1 * 4/2004 Melrose et al. ..... 215/381
2004/0149677 A1 * 8/2004 Slat et al. ..... 215/380
2004/0173565 A1 9/2004 Semersky et al.
2004/0211746 A1 10/2004 Trude
2004/0232103 A1 11/2004 Lisch et al.
2005/0211662 A1 9/2005 Eaton et al.
2005/0218108 A1 * 10/2005 Bangi et al. ..... 215/384
2005/0263481 A1 * 12/2005 Tanaka et al. ..... 215/381
2006/0006133 A1 * 1/2006 Lisch et al. ..... 215/374

(56) References Cited

U.S. PATENT DOCUMENTS

| | | | | |
|---|---|---|---|---|
| 2006/0138074 | A1* | 6/2006 | Melrose | 215/373 |
| 2006/0231985 | A1* | 10/2006 | Kelley | 264/523 |
| 2006/0243698 | A1 | 11/2006 | Melrose | |
| 2006/0255005 | A1* | 11/2006 | Melrose et al. | 215/381 |
| 2006/0261031 | A1 | 11/2006 | Melrose | |
| 2007/0017892 | A1 | 1/2007 | Melrose | |
| 2007/0045312 | A1 | 3/2007 | Abercrombie, III et al. | |
| 2007/0051073 | A1* | 3/2007 | Kelley et al. | 53/440 |
| 2007/0084821 | A1 | 4/2007 | Bysick et al. | |
| 2007/0125742 | A1 | 6/2007 | Simpson, Jr. et al. | |
| 2007/0125743 | A1 | 6/2007 | Pritchett, Jr. et al. | |
| 2007/0181403 | A1* | 8/2007 | Sheets et al. | 198/617 |
| 2007/0199915 | A1* | 8/2007 | Denner et al. | 215/375 |
| 2007/0199916 | A1 | 8/2007 | Denner et al. | |
| 2007/0215571 | A1* | 9/2007 | Trude | 215/373 |
| 2007/0235905 | A1 | 10/2007 | Trude et al. | |
| 2008/0047964 | A1* | 2/2008 | Denner et al. | 220/624 |
| 2008/0156847 | A1 | 7/2008 | Hawk et al. | |
| 2008/0257856 | A1* | 10/2008 | Melrose et al. | 215/381 |
| 2009/0090728 | A1 | 4/2009 | Trude et al. | |
| 2009/0091067 | A1 | 4/2009 | Trude et al. | |
| 2009/0092720 | A1 | 4/2009 | Trude et al. | |
| 2009/0120530 | A1 | 5/2009 | Kelley et al. | |
| 2009/0134117 | A1 | 5/2009 | Mooney | |
| 2009/0202766 | A1 | 8/2009 | Beuerle et al. | |
| 2009/0293436 | A1 | 12/2009 | Miyazaki et al. | |
| 2010/0018838 | A1 | 1/2010 | Kelley et al. | |
| 2010/0133228 | A1 | 6/2010 | Trude | |
| 2010/0163513 | A1 | 7/2010 | Pedmo | |
| 2010/0170199 | A1 | 7/2010 | Kelley et al. | |
| 2010/0237083 | A1 | 9/2010 | Trude et al. | |
| 2010/0301058 | A1 | 12/2010 | Trude et al. | |
| 2011/0049083 | A1 | 3/2011 | Scott et al. | |
| 2011/0113731 | A1 | 5/2011 | Bysick et al. | |
| 2011/0147392 | A1 | 6/2011 | Trude et al. | |
| 2011/0210133 | A1 | 9/2011 | Melrose et al. | |
| 2012/0104010 | A1 | 5/2012 | Kelley | |
| 2012/0107541 | A1 | 5/2012 | Nahill et al. | |
| 2012/0132611 | A1 | 5/2012 | Trude et al. | |
| 2012/0152964 | A1 | 6/2012 | Kelley et al. | |
| 2012/0240515 | A1 | 9/2012 | Kelley et al. | |
| 2012/0266565 | A1 | 10/2012 | Trude et al. | |
| 2012/0267381 | A1 | 10/2012 | Trude et al. | |
| 2013/0000259 | A1 | 1/2013 | Trude et al. | |

FOREIGN PATENT DOCUMENTS

| | | | |
|---|---|---|---|
| DE | 1761753 | | 1/1972 |
| DE | P2102319.8 | | 8/1972 |
| DE | 3215866 | A1 | 11/1983 |
| EP | 225 155 | A2 | 6/1987 |
| EP | 225155 | A2 | 6/1987 |
| EP | 346518 | A1 | 12/1989 |
| EP | 0 502 391 | A2 | 9/1992 |
| EP | 0 505054 | A1 | 9/1992 |
| EP | 0521642 | A1 | 1/1993 |
| EP | 0 551 788 | A1 | 7/1993 |
| EP | 0666222 | A1 | 2/1994 |
| EP | 0 739 703 | | 10/1996 |
| EP | 0 609 348 | B1 | 2/1997 |
| EP | 0916406 | A2 | 5/1999 |
| EP | 0957030 | A2 | 11/1999 |
| EP | 1 063 076 | A1 | 12/2000 |
| FR | 1571499 | | 6/1969 |
| FR | 2607109 | | 5/1988 |
| GB | 781103 | | 8/1957 |
| GB | 1113988 | | 5/1968 |
| GB | 2050919 | A | 1/1981 |
| GB | 2372977 | A | 9/2002 |
| JP | 48-31050 | | 9/1973 |
| JP | 49-28628 | | 7/1974 |
| JP | 54-72181 | A | 6/1979 |
| JP | S54-70185 | | 6/1979 |
| JP | S54-145640 | | 11/1979 |
| JP | 56-56830 | A | 5/1981 |
| JP | S56-62911 | | 5/1981 |
| JP | 56-72730 | U | 6/1981 |
| JP | S56-150815 | | 11/1981 |
| JP | 57-210829 | A | 1/1982 |
| JP | S57-17730 | | 1/1982 |
| JP | 57-37827 | | 2/1982 |
| JP | 57-37827 | U | 2/1982 |
| JP | 57-126310 | | 8/1982 |
| JP | 58-055005 | | 4/1983 |
| JP | 61-192539 | A | 8/1986 |
| JP | 63-189224 | A | 8/1988 |
| JP | 64-004662 | | 2/1989 |
| JP | 3-43342 | | 2/1991 |
| JP | 3-43342 | A | 2/1991 |
| JP | 03-076625 | | 4/1991 |
| JP | 4-10012 | | 1/1992 |
| JP | H05-81009 | | 4/1993 |
| JP | 5-193694 | | 8/1993 |
| JP | 53-10239 | A | 11/1993 |
| JP | 06-270235 | A | 9/1994 |
| JP | 6-336238 | A | 12/1994 |
| JP | 07-300121 | A | 11/1995 |
| JP | H08-048322 | | 2/1996 |
| JP | 08-244747 | A | 9/1996 |
| JP | 8-253220 | A | 10/1996 |
| JP | 8-282633 | A | 10/1996 |
| JP | 09-001639 | A | 1/1997 |
| JP | 09-039934 | A | 2/1997 |
| JP | 9-110045 | A | 4/1997 |
| JP | 10-167226 | A | 6/1998 |
| JP | 10-181734 | A | 7/1998 |
| JP | 10-230919 | A | 9/1998 |
| JP | 3056271 | | 11/1998 |
| JP | 11-218537 | A | 8/1999 |
| JP | 2000-229615 | A | 8/2000 |
| JP | 2002-127237 | A | 5/2002 |
| JP | 2002-160717 | A | 6/2002 |
| JP | 2002-326618 | A | 11/2002 |
| JP | 2003-095238 | | 4/2003 |
| JP | 2004-026307 | A | 1/2004 |
| JP | 2006-501109 | | 1/2006 |
| JP | 2007-216981 | A | 8/2007 |
| JP | S40-15909 | | 11/2007 |
| JP | 2008-189721 | A | 8/2008 |
| JP | 2009-096504 | | 5/2009 |
| NZ | 240448 | | 6/1995 |
| NZ | 296014 | | 10/1998 |
| NZ | 335565 | | 10/1999 |
| NZ | 506684 | | 9/2001 |
| NZ | 512423 | | 9/2001 |
| NZ | 521694 | | 10/2003 |
| WO | WO 93/09031 | A1 | 5/1993 |
| WO | WO 93/12975 | A1 | 7/1993 |
| WO | WO 94/05555 | | 3/1994 |
| WO | WO 94/06617 | | 3/1994 |
| WO | WO 97/03885 | | 2/1997 |
| WO | WO 97/14617 | | 4/1997 |
| WO | WO 97/34808 | | 9/1997 |
| WO | WO 97/34808 | A1 | 9/1997 |
| WO | WO 99/21770 | | 5/1999 |
| WO | WO 00/38902 | A1 | 7/2000 |
| WO | WO 00/51895 | A1 | 9/2000 |
| WO | WO 01/12531 | A1 | 2/2001 |
| WO | WO 01/40081 | A1 | 6/2001 |
| WO | WO 01/74689 | A1 | 10/2001 |
| WO | WO 02/02418 | A1 | 1/2002 |
| WO | WO 02/18213 | A1 | 3/2002 |
| WO | WO 02/085755 | | 10/2002 |
| WO | WO 2004/028910 | A1 | 4/2004 |
| WO | WO 2004/106176 | A2 | 9/2004 |
| WO | WO 2004/106175 | A1 | 12/2004 |
| WO | WO 2005/012091 | A2 | 2/2005 |
| WO | WO 2005/025999 | A1 | 3/2005 |
| WO | WO 2005/087628 | A1 | 9/2005 |
| WO | WO 2006/113428 | A3 | 10/2006 |

(56) References Cited

FOREIGN PATENT DOCUMENTS

| | | | |
|---|---|---|---|
| WO | WO 2007/047574 | A1 | 4/2007 |
| WO | WO 2007/127337 | A2 | 11/2007 |
| WO | WO 2010/058098 | A2 | 5/2010 |

OTHER PUBLICATIONS

Non-final Office Action dated Aug. 29, 2012 in U.S. Appl. No. 13/450,872.
International Search report dated Apr. 21, 2010 from corresponding PCT/US2009/066191 filed Dec. 1, 2009.
International Preliminary Report on Patentability and Written Opinion dated Jun. 14, 2011 for PCT/US2009/066191.
Office Action dated Aug. 14, 2012 in Japanese Patent Application No. 2008-535769.
Final Rejection dated Sep. 14, 2012, in U.S. Appl. No. 12/964,127.
Nonfinal Office Action dated Sep. 24, 2012, in U.S. Appl. No. 12/184,368.
International Search Report and Written Opinion for PCT/US2012/050251 dated Nov. 16, 2012.
Final Rejection dated Nov. 14, 2012, in U.S. Appl. No. 12/916,528.
U.S. Appl. No. 13/210,350, filed Aug. 15, 2011, Wurster et al.
U.S. Appl. No. 13/251,966, filed Oct. 3, 2011, Howell et al.
U.S. Appl. No. 13/210,358, filed Aug. 15, 2011, Wurster et al.
U.S. Appl. No. 13/410,902, filed Mar. 2, 2012, Gill.
The file wrapper and contents of U.S. Appl. No. 60/220,326, filed Jul. 24, 2000 dated Oct. 29, 2008.
Final Office Action for U.S. Appl. No. 10/558,284 dated Sep. 9, 2008.
Office Action for U.S. Appl. No. 10/558,284 dated Jan. 25, 2008.
Office Action for U.S. Appl. No. 10/851,083 dated Nov. 28, 2008.
Final Office Action for U.S. Appl. No. 10/851,083 dated Jun. 12, 2008.
Office Action for U.S. Appl. No. 10/851,083 dated Sep. 6, 2007.
International Search Report for PCT/US2005/008374 dated Aug. 2, 2005.
IPRP (including Written Opinion) for PCT/US2005/008374 dated Sep. 13, 2006.
International Search Report for PCT/US2004/016405 dated Feb. 15, 2005.
IPRP (including Written Opinion) for PCT/US2004/016405 dated Nov. 25, 2005.
Office Action for Application No. EP 06 750 165.0-2307 dated Nov. 24, 2008.
International Search Report for PCT/US2006/040361 dated Feb. 26, 2007.
IPRP (including Written Opinion) for PCT/US2006/040361 dated Apr. 16, 2008.
International Search Report for PCT/US2007/006318 dated Sep. 11, 2007.
IPRP (including Written Opinion) PCT/US2007/006318 dated Sep. 16, 2008.
IPRP (including Written Opinion) PCT/US2006/014055 dated Oct. 16, 2007.
International Search Report for PCT/US2004/024581 dated Jul. 25, 2005.
IPRP (including Written Opinion) for PCT/US2004/024581 dated Jan. 30, 2006.
Final Office Action for U.S. Appl. No. 10/566,294 dated Feb. 13, 2009.
Office Action for U.S. Appl. No. 10/566,294 dated Oct. 27, 2008.
"Application and Development of PET Plastic Bottle," Publication of Tsinghad Tongfang Optical Disc Co. Ltd., Issue 4, 2000, p. 41. (No English language translation available).
International Search Report and Written Opinion dated Mar. 15, 2010 for PCT/US2010/020045.
Chanda, M. & Roy, Salil K., Plastics Technology Handbook, Fourth Edition, 2007, CRC Press, Taylor & Francis Group, pp. 2-24-2-37.
Official Notification for counterpart Japanese Application No. 2006-522084 dated May 19, 2009.
Examination Report for counterpart New Zealand Application No. 545528 dated Jul. 1, 2008.
Examination Report for counterpart New Zealand Application No. 569422 dated Jul. 1, 2008.
Examination Report for New Zealand Application No. 550336 dated Mar. 26, 2009.
Examination Report for counterpart New Zealand Application No. 545528 dated Sep. 20, 2007.
Examination Report for counterpart New Zealand Application No. 569422 dated Sep. 29, 2009.
Office Action for Chinese Application No. 2006800380748 dated Jul. 10, 2009.
Examiner's Report for Australian Application No. 2006236674 dated Sep. 18, 2009.
Examiner's Report for Australian Application No. 2006236674 dated Nov. 6, 2009.
Office Action for Chinese Application No. 200680012360.7 dated Jul. 10, 2009.
Examination Report for New Zealand Application No. 563134 dated Aug. 3, 2009.
Office Action for European Application No. 07752979.0-2307 dated Aug. 21, 2009.
International Search Report for PCT/US2006/014055 dated Dec. 7, 2006.
International Search Report and Written Opinion dated Sep. 8, 2009 for PCT/US2009/051023.
Office Action dated Feb. 3, 2010 for Canadian Application No. 2,604,231.
Communication dated Mar. 9, 2010 for European Application No. 09 173 607.4 enclosing European search report and European search opinion dated Feb. 25, 2010.
European Search Report for EPA 10185697.9 dated Mar. 21, 2011.
Office Action, Japanese Application No. 2008-506738 dated Aug. 23, 2011.
Extended European Search Report for EPA 10185697.9 dated Jul. 6, 2011.
Patent Abstracts of Japan, vol. 012, No. 464; Dec. 6, 1988.
Patent Abstracts of Japan, vol. 2002, No. 09, Sep. 4, 2002.
Patent Abstracts of Japan, vol. 015, No. 239, Jun. 20, 1991.
Taiwanese Office Action dated Jun. 10, 2012, Application No. 095113450.
Japanese First Notice of Reasons for Rejection dated Aug. 23, 2011, in Application No. 2008-506738.
Japanese Second Notice of Reasons for Rejection dated Jun. 11, 2012, in Application No. 2008-506738.
Examiner's Report dated Feb. 15, 2011 in Application No. AU200630483.
Office Action dated Oct. 31, 2011, in Australian Patent Application No. 2011203263.
Office Action dated Jul. 19, 2011, in Japanese Patent Application No. 2008-535769.
Office Action dated Dec. 6, 2011, in Japanese Patent Application No. 2008-535769.
International Search Report and Written Opinion for PCT/US2012/050256 dated Dec. 6, 2012.
Requisition dated Feb. 3, 2010 for Canadian Application No. 2,604,231.
Requisition dated Jan. 9, 2013 for Canadian Application No. 2,559,319.
Office Action dated Feb. 5, 2013, in Mexican Patent Application No. MX/a/2008/004703.
Office Action dated Jul. 26, 2010 for Canadian Application No. 2,527,001.
Australian Office Action dated Mar. 3, 2011 in Application No. 2010246525.
Australian Office Action dated Nov. 8, 2011, in Application No. 2011205106.
Examiner Report dated May 26, 2010, in Australian Application No. 2004261654.
Examiner Report dated Jul. 23, 2010, in Australian Application No. 2004261654.

(56) References Cited

OTHER PUBLICATIONS

Requisition dated May 25, 2010 for Canadian Application No. 2,534,266.
Communication dated Jun. 16, 2006, for European Application No. 04779595.0.
Final Official Notification dated Mar. 23, 2010 for Japanese Application No. 2006-522084.
International Search Report and Written Opinion dated Dec. 18, 2012, in PCT/US12/056330.
Supplementary European Search Report for EP Application No. 10729403.5, dated May 21, 2013.

* cited by examiner

DEFORMABLE CONTAINER WITH HOOP RINGS

CROSS-REFERENCE TO RELATED APPLICATIONS

This application is a continuation of application Ser. No. 12/651,461 filed Jan. 2, 2010, which is a continuation of application Ser. No. 12/349,268 filed Jan. 6, 2009 (now U.S. Pat. No. 7,926,243 issued on Apr. 19, 2011), the entire content of each of the foregoing is hereby incorporated by reference into the present application.

The present invention relates generally to a method and system for handling or conveying filled containers. In particular, the present invention relates to a method and system for handling or conveying, prior to activation of a moveable element, a filled and sealed plastic bottle having a side portion deformed due to a vacuum created therein.

In one aspect, exemplary embodiments of the present invention relate to a method for handling hot-filled plastic bottles. Each plastic bottle can include a neck portion, a body portion, and a base portion. The body portion may have a first concave hoop ring, a second concave hoop ring, and an annular smooth sidewall portion free of vacuum panels arranged between the first and the second concave hoop rings. The base portion may form a standing surface for the plastic bottle and can have a bottom end thereof with a moveable element configured to be activated. The method can comprise hot-filling the plastic bottles, capping the hot-filled plastic bottles, creating a vacuum in each of the hot-filled and capped plastic bottles by cooling, conveying the plastic bottles having temporary deformations, and after the conveying, activating the moveable element of each conveyed plastic bottle. Creating a vacuum in the plastic bottle can cause temporary deformation of the corresponding plastic bottle. The temporary deformation for each plastic bottle can be substantially confined to the annular smooth sidewall portion, with substantially no deformation of the first concave hoop ring and the second concave hoop ring. The conveying can be such that each plastic bottle is in contact with a plurality of other plastic bottles, wherein the first and the second concave hoop rings for each plastic bottle can provide for substantially stable touch points for conveyance of the plastic bottles while the plastic bottles are conveyed with the temporary deformations in the annular smooth sidewall portion. The activating can include moving the moveable element from a first position to a second position, the second position being more toward the interior of the plastic bottle than the first position. The activating can remove at least a portion of the vacuum in the plastic bottle.

In another aspect, exemplary embodiments of the present invention relate to a system for handling filled containers. Each container can include a body and a base defining an inner volume. The body can have a first annular portion, a second annular portion, and a sidewall portion. The base can form a standing surface for the container and may have a bottom end thereof with a moveable element configured to be movable from a first, outwardly inclined position to a second, inwardly inclined position. The system can comprise filling means for filling a container with a product at an elevated temperature, capping means for capping and sealing the filled container with a cap, cooling means for cooling the filled and capped container, handling means for handling the cooled container, and inverting means for inverting the moveable element. The cooling of the container can create a vacuum in the container, the vacuum causing temporary distortion of the container. The temporary distortion can occur substantially at the sidewall portion, with the first annular portion and the second annular portion substantially resisting distortion. The handling can be performed such that one or more substantially stable touch points of the container are in contact with corresponding one or more substantially stable touch points of at least one other container. The one or more substantially stable touch points can be facilitated by an associated one of the first annular portion and the second annular portion. The moveable element can be inverted from a first, outwardly inclined position to the second, inwardly inclined position to remove a portion of the vacuum.

In yet another aspect, exemplary embodiments of the present invention relate to a method for conveying a plurality of filled plastic containers. Each plastic container may include a body portion and a base portion, the base portion forming a support surface for supporting the container on a substantially flat surface and the base portion having a moveable element arranged at a bottom end thereof. The moveable element can be moveable substantially permanently to remove a vacuum in the container. The method can comprise cooling a plurality of hot-filled and capped plastic containers, conveying the plastic containers, and activating, after the conveying, the vacuum panel of each plastic container. The cooling can create a vacuum in each of the hot-filled and capped plastic containers. Each vacuum can cause temporary deformation of the corresponding plastic container, the temporary deformation being directed to a predetermined specified portion of the container. The conveying can include temporarily compensating for vacuums created in the cooled containers and maintaining stable touch points. The activating can include moving the moveable element from a first position to a second position substantially permanently to remove a portion of the vacuum.

DETAILED DESCRIPTION

Aspects of the present invention are directed to a problem encountered during conveyance of hot-filled and capped containers after cooling, but prior to base activation of the containers. The problem involves relief for temporary deformation of the containers (e.g., in the container sidewalls) caused by vacuums induced in the filled and sealed containers as a result of cooling the hot product. For example, the vacuums may cause the containers to contract to an oval or other temporarily deformed shape. Such temporary deformations can cause reliability problems in conveying or transporting the containers, as the temporary deformations may provide unstable support points between adjacent, touching containers. As a result, speed, efficiency, and reliability of conveyance and handling may deteriorate.

The inventors of the present invention have identified ways to overcome the foregoing problems, without having to provide relatively thick sidewalls to resist the temporary deformation caused by an induced vacuum. Specifically, embodiments of the present invention provide for stable touch points for the containers by providing annular portions to confine the temporary deformation to a predetermined smooth sidewall portion, while preventing distortion of portions of the container that contact other containers during conveyance or handling. Alternative embodiments of the present invention provide for stable touch points for the containers during conveyance prior to activation by directing the temporary deformation to one or more temporary vacuum panels that temporarily compensate for the vacuum until the vacuum is permanently removed or reduced by activating.

Figure 1:
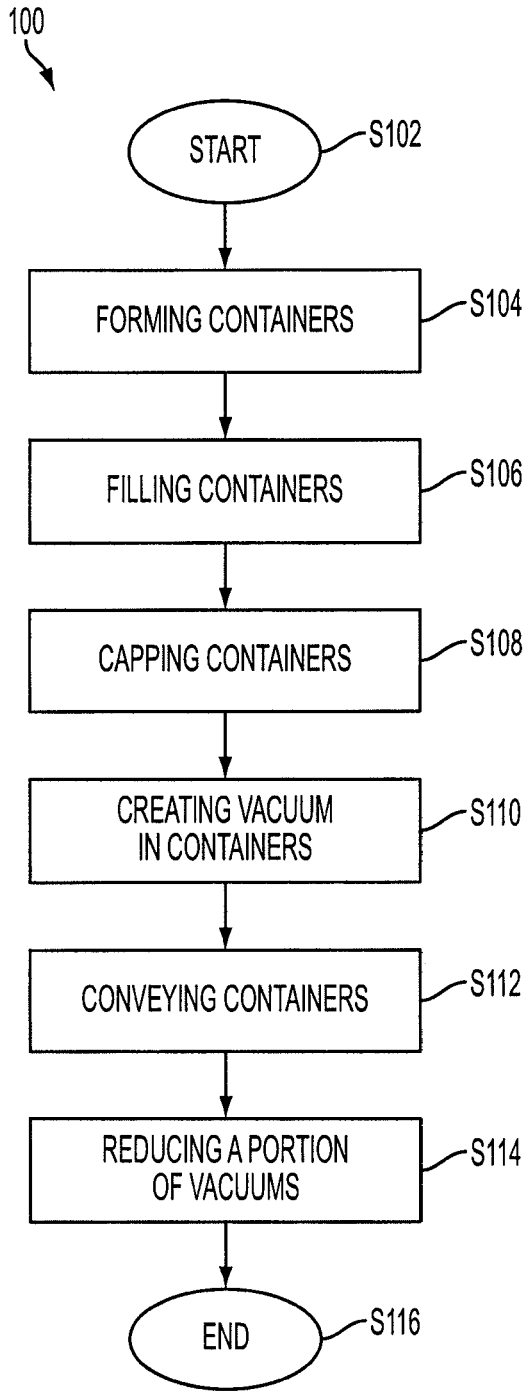
FIG. 1 provides a flow chart illustrating an exemplary embodiment of a method in accordance with the present invention.

FIG. 1 is a flow chart representation of a method 100 according to various embodiments of the present invention. Method 100 can be any suitable method. For example, generally speaking, method 100 can be for conveying or handling a plurality of filled containers, such as hot-filled plastic bottles. Method 100 can start at S102 and proceed to any suitable step or operation. In various embodiments, the method can proceed to S104.

S104 can be any suitable step or operation. In various embodiments, S104 can represent forming a container or containers. The containers can be formed by any suitable manner and by any suitable means. In various embodiments, the containers can be blow molded or injection blow molded using, for example, a rotary blow molding apparatus.

The containers can be made of any suitable material. For example, the containers can be made of plastic materials known in the art. The containers may have, for example, a one-piece construction and can be prepared from a monolayer plastic material, such as a polyamide (e.g., nylon); a polyolefin such as polyethylene (e.g., low density polyethylene (LDPE), high density polyethylene (HDPE)) or polypropylene; a polyester (e.g., polyethylene terephthalate (PET), polyethylene naphtalate (PEN)); or others, which can also include additives to vary the physical or chemical properties of the material. Optionally, the containers can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties.

The containers can be formed to have any suitable shape and configuration. In various embodiments, the containers may be formed (e.g., by blow molding) with an approximately polygonal, circular or oval projection extending, for example, from a bottom end of a base portion of the container. In various embodiments, this projection can be a moveable element, such as, but not limited to, a vacuum panel. Optionally, or additionally, a projection may project from the shoulders of the container, or from another area of the container. If the projection extends from the bottom end of the base portion of the container, before the container exits the forming operation, the projection may be inverted or moved inside the container to make the base surface of the blow-molded container relatively flat so the container can be conveyed on a table top.

Figure 3A:
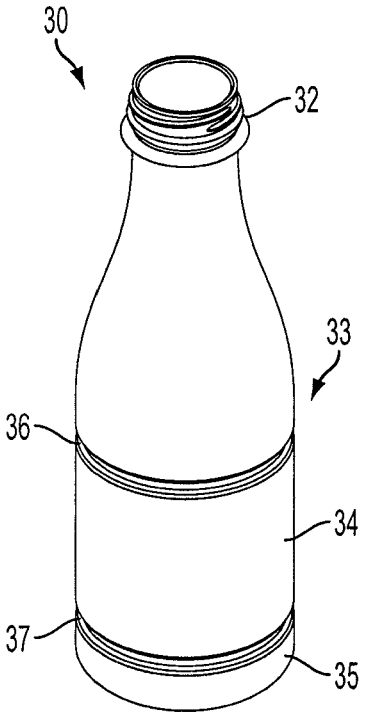
FIG. 3A is an overhead front view of another exemplary container for conveying or handling by the system and method according to various embodiments of the present invention.
Figure 3B:
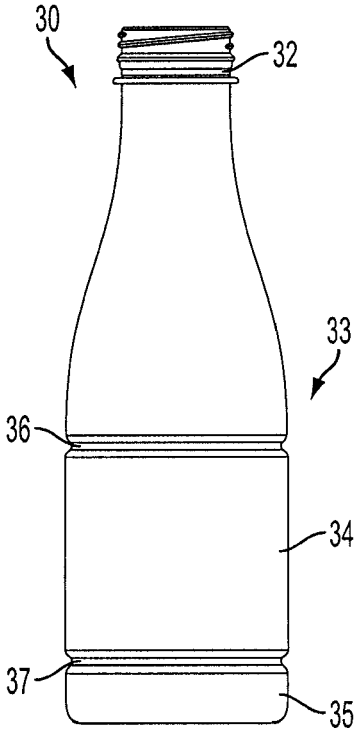
FIG. 3B is a side view of the container in FIG. 3A.
Figure 3C:
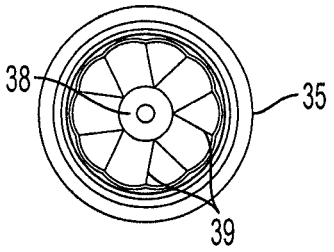
FIG. 3C is a bottom view of the container in FIG. 3A.
Figure 4:
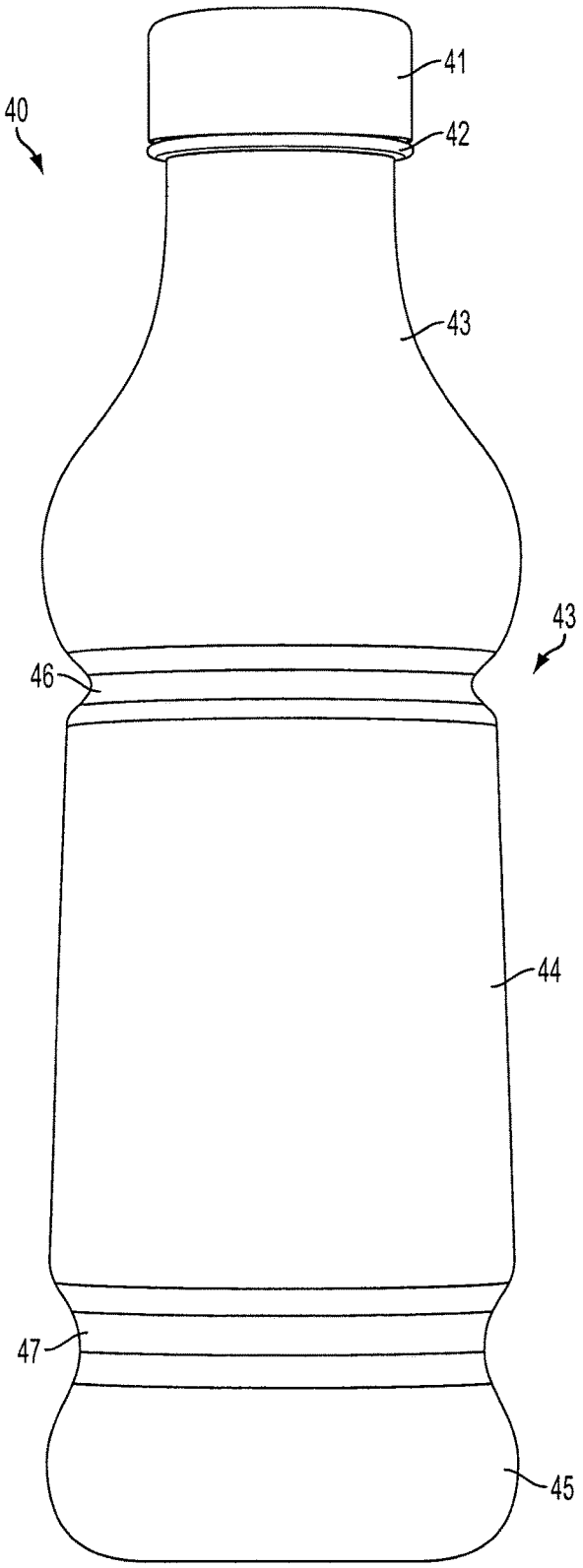
FIG. 4 is a side view of yet another exemplary container, with a cap, for conveying or handling by the system and method according to various embodiments of the present invention.

FIGS. 2-4 show examples of containers that can be formed at forming step S104. The containers 20, 30, 40 shown in FIGS. 2-4 are shown in their respective configurations after the forming step. For example, the containers 20, 30, 40 shown in FIGS. 2-4 are shown after exiting a blow molding operation. Note that the containers shown in FIGS. 2-4 are generally cylindrical along a central longitudinal axis. However, the containers used in the method and system according to various embodiments are not limited to being cylindrical and can be any suitable shape, such as generally rectangular, oval, or triangular along a central longitudinal axis.

Figure 2A:
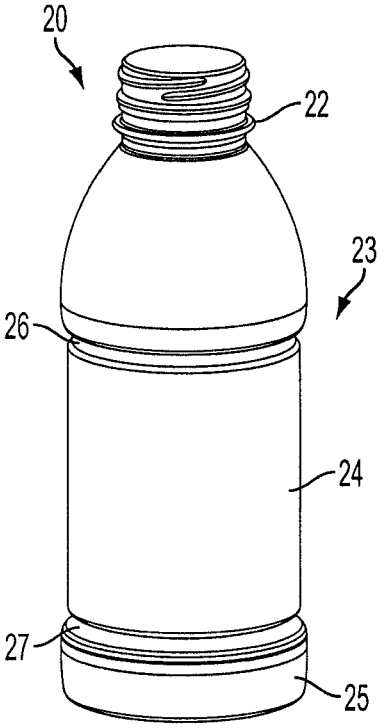
FIG. 2A is an overhead front view of an exemplary container for conveying or handling by the system and method according to various embodiments of the present invention.
Figure 2B:
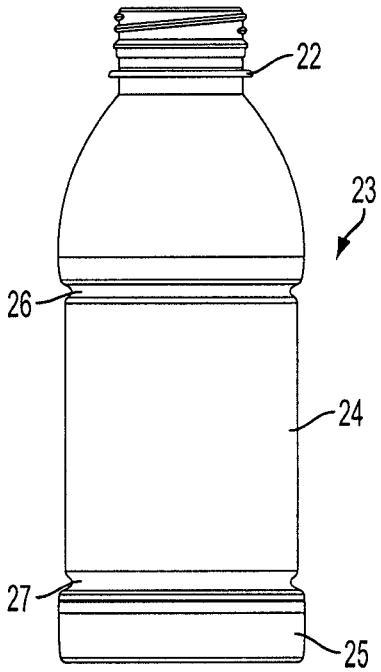
FIG. 2B is a side view of the container in FIG. 2A.
Figure 2C:
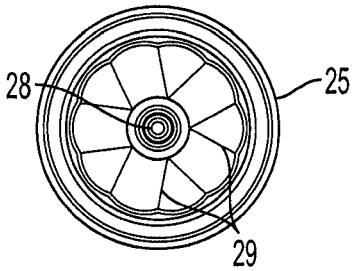
FIG. 2C is a bottom view of the container in FIG. 2A.

FIG. 2 is comprised of FIGS. 2A-2C. FIGS. 2A-2C respectively correspond to an exemplary embodiment of a container 20 conveyed or handled by various embodiments of the method and system of the present invention. The container 20 shown in FIGS. 2A and 2B can include a neck portion 22, a body portion 23, and a base portion 25 defining an inner volume.

Neck portion 22 can be of any suitable configuration. For example, neck portion 22 can be configured to allow a cap or lid (not shown) to be coupled thereto to seal the container. The cap or lid can be removably coupled to the neck portion 22 by any suitable means, such as threads, snap-fitted, etc. Neck portion 22 also may have a lip having a greater diameter than the general overall diameter of the part of the neck portion 22 that receives the cap or lid, wherein the lip may be arranged such that one side abuts the end of the cap or lid (including frangible "tamper rings"), and such that the other side is used as a support for rail conveyance systems, for example. The neck portion 22 can be sized to allow a spout of a filling apparatus or machine to be positioned adjacent or slightly into the inner volume thereof to fill the container 20 with a product.

Body portion 23 can be of any suitable configuration. For example, body portion 23 can be configured substantially as shown in FIGS. 2A and 2B, with a portion that tapers outward from neck portion 22 (e.g., forming a generally conical bell section), a first annular portion 26, a sidewall portion 24, and a second annular portion 27.

The first annular portion 26 and the second annular portion 27 can be of any suitable configuration, shape, or size. In various embodiments, the first annular portion 26 and the second annular portion 27 can be rounded. Optionally, the first and second annular portions can be concave hoop rings. As to size, the annular portions 26, 27 can be between 3 mm to 5 mm tall and 2 mm to 4 mm deep, for example. Generally the first and second annular portions 26, 27 are the same shape and size. Optionally, the annular portions can be different in size and/or shape. For example, a deeper first annular portion 26 can be used, with dimensions such as 5 mm to 15 mm tall and 5 mm to 8 mm deep. Alternatively, the second annular portion 27 may have larger dimensions than the first annular portion 26. In FIG. 2B, the container 20 can have a part of the body portion 23 above the first annular portion 26 that is greater in diameter than the first annular portion 26 and the second annular portion 27. This part may be sized to contact one or more adjacent containers during conveyance and handling of the containers. For example, after a cooling operation or process, the part of the body portion 23 above the first annular portion 26 greater in diameter than the first annular portion may contact substantially similar parts on one or more other containers, thereby providing a stable contact or touch point for conveyance.

The first annular portion 26 and the second annular portion 27 can be located at any suitable place along the body portion 23 in relation to one another or to another portion of the container 20. For example, as shown in FIGS. 2A and 2B, the annular portions 26, 27 are at opposite sides of sidewall portion 24, with the first annular portion 26 being located above the sidewall portion 24 and the second annular portion 27 being located below the sidewall portion 24. Also note that though two annular portions are shown, the container can have any suitable number of annular portions, such as one, two, three, etc.

The sidewall portion 24 can be of any suitable shape or configuration. For example, the sidewall portion 24 shown in FIGS. 2A and 2B can be smooth and cylindrical. In various embodiments, the sidewall portion 24 is free of any vacuum panels, such as supplemental or mini vacuum panels. Optionally, sidewall portion 24 also can be free of any additional features, such as grips, ribs, etc. In various embodiments, the sidewall portion 24 can be "waisted" in (such that the shape is convex).

As noted above, first annular portion 26 and second annular portion 27 can be arranged at any suitable position of body portion 23. In various embodiments, first annular portion 26 and second annular portion 27 can be spaced apart from one another by sidewall portion 24, such that the sidewall portion 24 is capable of deforming or distorting, while the annular portions and areas above and below the first and second annular portions, respectively, substantially maintain their shape or substantially resist deformation or distortion. As will be discussed below in greater detail, the first annular portion 26 and the second annular portion 27 may be configured to create substantially stable contact points above and below a portion of the container that deforms or distorts, such as the sidewall portion 24. For conveyance or handling, and as will be described further below, such a configuration of annular portions 26, 27 and flexible sidewall portion 24 may allow the sidewall portion 24 of the container 20 to be free of structural geometry when using an offsetting pressure mechanism after hot filling and cooling the container, such as inverting a moveable element.

Base portion 25 can be of any suitable configuration. For example, base portion 25 can be generally cylindrical, rectangular, or triangular about a central longitudinal axis. The base portion 25 shown in FIG. 2, for example, is cylindrical. In various embodiments, base portion 25 can have one end coupled to second annular portion 27 and another end thereof forming a standing surface upon to support the container 20 on a substantially flat surface. The part of the base portion 25 coupled to the second annular portion 27 can have a diameter greater than a diameter of the second annular portion 27 and the first annular portion 26. In various embodiments, the diameter of the part of the base portion 25 coupled to the second annular portion 27 can have substantially the same diameter as the part of the body portion 23 immediately above the first annular portion 26. This part of the base portion 25 may be sized to contact one or more adjacent containers during conveyance and handling of the containers. For example, after a cooling operation or process, the part of the base portion 25 below the second annular portion 27 greater in diameter may contact substantially similar parts on one or more other containers, thereby providing a stable contact or touch point for conveyance.

In various embodiments, base portion 25 also may have a moveable element formed in a bottom end thereof. FIG. 2C shows an exemplary moveable element 28 according to various embodiments of the present invention. The moveable element 28 can initially be formed (e.g., blow molded) to project below the standing surface of the container 20, and prior to exiting or immediately after exiting the forming operation, the moveable element 28 initially projecting below the standing surface can be moved or manipulated such that it is entirely above the standing surface of the container for operations or steps after leaving the forming step or operation. In various embodiments, the moveable element 28 can be moved above the standing surface of the container so the standing surface of the container can provide a stable surface for supporting the container of a substantially flat surface, for example.

Moveable element 28 can be of any suitable configuration. In various embodiments, moveable element 28 can have creases 29, which can facilitate repositioning or inverting of the moveable element 28. After the forming operation, the moveable element 28 may be configured to be moved from a first position to a second position. In various embodiments, such movement is called activating or activation. Moreover, in various embodiments, the moveable element 28 can be configured such that in the first position, at least a substantially planar portion of the moveable element is at an outwardly inclined position with respect to the interior of the container 20, and such that in the second position, at least a substantially planar portion thereof is at an inwardly inclined position. In various embodiments, the substantially planar portion for the outwardly inclined position is the same as the substantially planar portion for the inwardly inclined position.

The moveable element 28 can be configured substantially permanently to compensate for vacuum forces created by cooling the containers. In various embodiments, substantially permanently compensating may mean removing a portion of the vacuum until the container is opened by a consumer, for example. In this context, a portion of the vacuum may mean some of the vacuum, all of the vacuum, or all of the vacuum plus providing a positive pressure. Moveable element 28 also may have an anti-inverting portion. In various embodiments, the anti-inverting portion may be configured to move with the portion of the moveable element that moves from an outwardly inclined position to an inwardly inclined position. Note, however, that the anti-inverting portion may be generally inwardly inclined at both of the foregoing positions.

FIG. 3, which is comprised of FIGS. 3A-3C, illustrate another exemplary embodiment of a container 30 conveyed or handled by various embodiments of the method and system of the present invention. The container 30 shown in FIGS. 3A and 3B can include a neck portion 32, a body portion 33, and a base portion 35 defining an inner volume.

Neck portion 32 can be of any suitable configuration. In various embodiments, the neck portion 32 is substantially the same as that described above for FIG. 2. Note that the diameter for the opening of the neck portion 32 may or may not be the same as that of FIG. 2.

Body portion 33 can be of any suitable configuration. For example, body portion 33 can be configured substantially as shown in FIGS. 3A and 3B, with a portion that tapers outward from neck portion 32 (e.g., forming a generally conical bell section), a first annular portion 36, a sidewall portion 34, and a second annular portion 37. Different from the body portion 23 in FIG. 2, the tapering portion (e.g., bell portion from neck to first annular portion 36) can also include a two-step conical section to form the shape of a long neck style container.

The first annular portion 36 and the second annular portion 37 can be of any suitable configuration, shape, or size. In various embodiments, the first annular portion 36 and the second annular portion 37 can be rounded. Optionally, the first and second annular portions can be concave hoop rings. As to size, the annular portions 36, 37 can be between 3 mm to 5 mm tall and 2 mm to 4 mm deep. Generally the first and second annular portions 36, 37 are the same shape and size. Optionally, the annular portions can be different in size and/or shape. For example, a deeper first annular portion 36 can be used, with dimensions of 5 mm to 15 mm tall and 5 mm to 8 mm deep, for example. Optionally, the second annular portion 37 may have larger dimensions than the first annular portion 36. In FIG. 3B, the container 30 can have a part of the body portion 33 above the first annular portion 36 that is greater in diameter than the first annular portion 36 and the second annular portion 37. This part may be sized to contact one or more adjacent containers during conveyance and handling of the containers. For example, after a cooling operation or process, the part of the body portion 33 above the first annular portion 36 greater in diameter may contact substantially similar parts on one or more other containers, thereby providing a substantially stable contact or touch point for conveyance. Optionally, one or both of the first annular portion 36 and the second annular portion 37 may comprise the part of the body portion 33 that contacts corresponding parts of adjacent container as the containers are conveyed or handled.

The first annular portion 36 and the second annular portion 37 can be located at any suitable place along the body portion 33 in relation to one another or to another portion of the container 30. For example, as shown in FIGS. 3A and 3B, the annular portions 36, 37 are at opposite sides of sidewall portion 34, with the first annular portion 36 being located above the sidewall portion 34 and the second annular portion 37 being located below the sidewall portion 34. Also note that though two annular portions are shown, the container can have any suitable number of annular portions, such as one, two, three, etc.

The sidewall portion 34 can be of any suitable shape or configuration. For example, the sidewall portion 34 shown in FIGS. 3A and 3B can be smooth and cylindrical. Note that the sidewall portion 34 may be shorter than the sidewall portion 24 in FIGS. 2A and 2B. In various embodiments, the sidewall portion 34 is free of any vacuum panels, such as supplemental or mini vacuum panels. Optionally, the sidewall portion 34 can be free of any additional elements, such as ribs, grips, etc. In various embodiments, the sidewall portion 34 can be "waisted" in (such that the shape is convex).

As noted above, first annular portion 36 and second annular portion 37 can be arranged at any suitable position of body portion 33. In various embodiments, first annular portion 36 and second annular portion 37 are spaced apart from one another by sidewall portion 34, such that the sidewall portion 34 is capable of deforming or distorting, while the areas above and below the first and second annular portions, respectively, substantially maintain their shape or substantially resist deformation or distortion. As will be discussed below in greater detail, the first annular portion 36 and the second annular portion 37 may be configured to create substantially stable contact points above and below a portion of the container that deforms or distorts, such as the sidewall portion 34. For conveyance or handling, and as will be described further below, such a configuration of annular portions 36, 37 and flexible sidewall portion 34 may allow the sidewall portion 34 of the container 30 to be free of structural geometry when using an offsetting pressure mechanism after hot filling and cooling the container, such as inverting a vacuum panel.

Base portion 35 can be of any suitable configuration. For example, base portion 35 can be generally cylindrical, rectangular, or triangular about a central longitudinal axis. The base portion 35 shown in FIG. 3, for example, is cylindrical. In various embodiments, base portion 35 can have one end coupled to second annular portion 37 and another end thereof forming a standing surface upon to support the container 30 on a substantially flat surface. The part of the base portion 35 coupled to the second annular portion 37 can have a diameter greater than a diameter of the second annular portion 37 and the first annular portion 36. In various embodiments, the diameter of the part of the base portion 35 coupled to the second annular portion 37 can have substantially the same diameter as the part of the body portion 33 immediately above the first annular portion 36. This part of the base portion 35 may be sized to contact one or more adjacent containers during conveyance and handling of the containers. For example, after a cooling operation or process, the part of the base portion 35 below the second annular portion 37 greater in diameter may contact substantially similar parts on one or more other containers, thereby providing a stable contact or touch point for conveyance. Optionally, one or more of the annular portions 36, 37 can comprise the stable contact or touch points.

In various embodiments, base portion 35 also may have a moveable element formed in a bottom end thereof. FIG. 3C shows an exemplary moveable element 38 according to various embodiments of the present invention. The moveable element 38 may be substantially the same as that described for FIG. 2 above. Note that the diameter of the base portion 35 may or may not be the same. Therefore, the moveable element 38 in FIG. 3C may differ from that of FIG. 2 in this respect.

Similar to FIG. 2 above, moveable element 38 for the container shown in FIG. 3 can be configured such that in the first position, at least a substantially planar portion of the moveable element is at an outwardly inclined position with respect to the interior of the container 30, and such that in the second position, at least a substantially planar portion thereof is at an inwardly inclined position. In various embodiments, the substantially planar portion for the outwardly inclined position is the same as the substantially planar portion for the inwardly inclined position. The moveable element 38 can be configured substantially permanently to compensate for vacuum forces created by cooling the containers. In various embodiments, substantially permanently compensating may mean removing a portion of the vacuum until the container is opened by a consumer, for example. In this context, a portion of the vacuum may mean some of the vacuum, all of the vacuum, or all of the vacuum plus providing a positive pressure. Moveable element 38 also may have an anti-inverting portion. In various embodiments, the anti-inverting portion is configured to move with the portion of the moveable element that moves from an outwardly inclined position to an inwardly inclined position. Note, however, that the anti-inverting portion may be generally inwardly inclined for both of the aforementioned positions.

FIG. 4 shows yet another exemplary embodiment of a container 40 conveyed or handled by various embodiments of the method and system of the present invention. The container 40 in FIG. 4 can have a neck portion 42, a body portion 43, and a base portion 45 defining an inner volume. The body portion 43 can include a substantially smooth sidewall 44, a first annular portion 46, and a second annular portion 47. The container 40 shown in FIG. 4 also is shown with a cap 41 coupled to neck portion 42. Cap 41 can be coupled to neck portion 42 by any suitable means, such as threads, snap connections, etc. Different from FIGS. 2 and 3, the smooth sidewall 44 shown in FIG. 4 tapers outward from its top to its bottom. Alternatively, the smooth sidewall 44 may taper inward from its top to its bottom. The annular portions 46, 47 may be substantially the same in functionality as those discussed above for FIGS. 2 and 3. In particular, the annular portions 46, 47 can be configured to provide one or more substantially stable touch points for conveyance and handling of the container 40 in contact with other adjacent containers in various operations of a production line, such as after cooling the containers and before activating the containers. Annular portions 46, 47 also can be configured to confine distortion or deformation of the container due to hot-filling and/or cooling operations to the smooth sidewall 44, for example. Note that in this embodiment, only the portion of the container 40 above the annular portion 46 may have a diameter greater than the smooth sidewall 44. As such, in this embodiment, only the rounded portion above the first annular portion 46 may serve as a substantially stable touch or contact point for conveying or handling with other containers. Optionally, the base portion 45 may be designed such that it has a diameter greater than the smooth sidewall 44 to serve as a substantially stable touch or contact point for conveying or handling with other containers. In various embodiments, a base portion 45 with a diameter greater than the smooth sidewall 44 can serve as the only touch or contact point for conveying or handling with other containers. Though not explicitly shown, container 40 can have a moveable member incorporated into the bottom end of the base portion 45. The moveable member can be substantially the same as described above for FIGS. 2 and 3.

The containers shown in FIGS. 2-4 are representative only and not meant to limit the scope of the type or configuration of containers capable of being conveyed or handled by the method and system according to various embodiments of the present invention.

Turning back to the method 100 shown in FIG. 1, after S104, the method 100 can proceed to any suitable step or operation. In various embodiments, the method 100 can proceed to S106.

At S106, the containers can be filled with a product. Note that after S104, the container can be moved or conveyed to a filling station by any suitable means or combination of means, such as palletized and shipped, a conveyor belt, a rotary apparatus, and/or feed screws. Before and during the filling, one or more of the annular portions can provide for substantially stable touch points. That is to say, before and during the filling, the containers can be in touching relationship with at least one other container, with the annular portions providing substantially stable touch points for stability during conveyance and handling.

The product can be filled using any suitable means, such as a filling station configured with a spout or spouts moveable to be positioned adjacent or slightly interior a top opening of the container, or adjacent or slightly interior respective top openings of containers in the case of multiple spouts. Moreover, containers can be filled successively, one at a time, or a group of containers can be filled substantially simultaneous. The product can be any suitable product including, but not limited to, carbonated beverages, non-carbonated beverages, water, tea, sports drinks, dry products, etc. In various embodiments, the product can be filled at an elevated temperature. For example, the product can be filled at a temperature of approximately 185 degrees Fahrenheit (85 degrees Celsius). During the filling, for containers having a moveable element in a bottom end portion, the moveable element can extend to the standing surface of the container, but not below it. Optionally, during filling for containers having a moveable element in a bottom end portion, the moveable element can be entirely above the standing surface.

After S106, the method 100 can proceed to any suitable step or operation. In various embodiments, the method 100 may proceed to S108. At S108, the containers may be capped. The containers can be capped by any suitable means, such as a mechanical apparatus that positions a cap or lid over each of the containers and appropriately couples the cap or lid to the neck portion of the container. Moreover, the containers can be capped successively, one at a time, or a group of containers can be capped substantially simultaneous. The capping means can couple the cap or lid to the neck portion of the container based on the means by which the cap or lid and neck are configured. For example, for threaded caps and neck portions, the capping means may move the cap such that the cap engages the threads of the neck.

Before and during the capping, one or more of the annular portions can provide for substantially stable touch points. That is to say, before and during the capping, the containers can be in touching relationship with at least one other container, with the annular portions providing substantially stable touch points for stability during this portion of the conveyance and handling of the containers. Additionally, the capping operation may create a substantially air-tight seal. In various embodiments, the filling at an elevated temperature and capping may create an overpressure within the container causing a portion of the container to distort or deform. In various embodiments, the first and second annular portions of the container can be configured to direct or confine the distortion or deformation to a smooth sidewall portion arranged therebetween. The deformation may be such that the smooth sidewall bows outward. In various embodiments, the container can be configured such that, in bowing outward, the smooth sidewall does not extend to an outer diameter of one or more portions of the container above and/or below the annular portions. Thus, in various embodiments, the annular portions can confine the deformation to the smooth sidewall and can provide for substantially stable touch points outside of the smooth sidewall for contact with touch points of other, adjacent containers. The deformation of the containers can be unpredictable in shape, size, and timing. Moreover, the deformation can be different in shape, size, and timing from container to container. During the capping, for containers having a moveable element in a bottom end portion, the moveable element can extend to the standing surface of the container, but not below it. Optionally, during capping for containers having a moveable element in a bottom end portion, the moveable element can be entirely above the standing surface.

After S108, the method 100 can proceed to any suitable step or operation. In various embodiments, the method 100 may proceed to S110.

At S110, a vacuum can be created in the filled and capped container. The vacuum can be created by any suitable means, such as by cooling. For example, a container can be cooled from about or around 185 degrees Fahrenheit to about or around 100 degrees Fahrenheit. Cooling, for example, can be performed by any suitable means, such as a traditional cooler, which may have ambient air or coolant blowing against the hot-filled containers to cool their contents to room temperature. In various embodiments, the filled and capped containers may be passed through a tunnel in which a fluid, such as water, may be sprayed in a shower-like fashion to cool the container. The fluid can be at any suitable temperature for cooling the product in the container. For example, the fluid can be at room temperature. As another example, the fluid can be at a temperature colder than room temperature. Generally, in this context, about or around 90 degrees Fahrenheit to about or around 100 degrees Fahrenheit may be characterized as "room temperature." However, room temperature is not limited to being at or between the aforementioned temperatures, and can be any suitable temperature designated as room temperature. Moreover, a temperature lower than room temperature may be, for example, about or around 75 degrees Fahrenheit to about or around 65 degrees Fahrenheit. Like room temperature above, the temperature below room temperature can be any suitable temperature designated as below room temperature.

As the product in the container cools, the cooled product typically contracts and a vacuum is induced in the container. In the context of the present invention, a vacuum created in the container by cooling or otherwise is based on a change in temperature from at or around the hot-filled temperature discussed above to at or around room temperature or below room temperature, as discussed above. The present invention does not contemplate vacuums of magnitude substantially outside the range created based on the aforementioned ranges of change in temperature, such as "infinite" vacuums.

The vacuum can cause distortion or deformation, such as roll out, "ovalization," "triangularization," etc. The distortion or deformation can be unpredictable in shape, size, and timing. Moreover, from container to container, the deformation or distortion can be different in shape, size, and timing, as well as unpredictable. Furthermore, typically the deformation or distortion is temporary. In various embodiments, the temporary deformation or distortion can be directed to a predetermined specified portion of the container. As noted above, container may be configured with annular portions, and the temporary deformation can be directed substantially to the smooth sidewall of the container, with substantially no deformation of the annular portions or of portions of the container above an upper annular portion or below a lower annular portion. Thus, in container embodiments with annular portions, the temporary deformation can be substantially confined to the smooth sidewall portion of the containers, with the annular portions substantially resisting deformation or distortion. In resisting deformation or distortion, the annular portions can also provide for respective substantially stable touch or contact points for contact with corresponding substantially stable touch points of other adjacent containers throughout or at various portions of conveying and handling. For example, for an upper annular portion, a substantially stable touch point can be located above the annular portion, and for a lower annular portion, a substantially stable touch point can be located below this annular portion, on a base portion of the container. In various embodiments, a portion of the annular portion can comprise the substantially stable touch or contact point.

Figure 8:
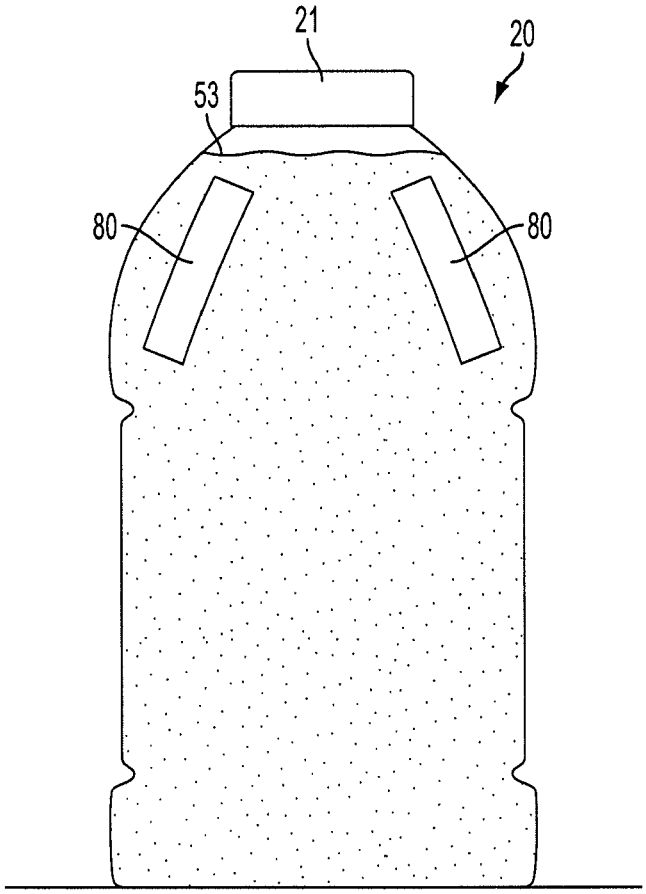
FIG. 8 is a side view of yet another exemplary container having a plurality of supplemental temporary vacuum panels according to various embodiments of the present invention.

In alternative embodiments, the temporary deformation caused by a vacuum induced by cooling, for example, can be directed to one or more supplemental vacuum panels. FIG. 8, for example, shows a configuration of a capped and filled container 20 having supplemental vacuum panels 80. The one or more supplemental vacuum panels 80 can temporarily compensate for the vacuum while conveying or handling containers prior to activation of a moveable element in the bottom end of a base portion to permanently remove the vacuum. Note that the container in FIG. 8 shows upper and lower "indentations" separated by a substantially smooth sidewall portion. These indentions may or may not be first and second annular portions substantially as described herein. Thus, alternative container embodiments are intended to provide temporary distortion or deformation compensation using only the one or more supplemental vacuum panels 80 or the one or more supplemental vacuum panels 80 in combination with annular portions that provide for substantially stable touch points. Note that the one or more supplemental vacuum panels 80 can also provide for one or more substantially stable touch points since temporary distortion or deformation is substantially confined thereto.

As with filling and capping, for creating a vacuum by cooling, for example, for containers having a moveable element in a bottom end portion, the moveable element can extend to the standing surface of the container, but not below it. Optionally, for creating a vacuum by cooling, for example, for containers having a moveable element in a bottom end portion, the moveable element can be entirely above the standing surface. Moreover, for a plurality of containers, the containers can have a vacuum induced therein in any suitable grouping or order. For example, containers can be passed through a cooling means in single file, with one or more substantially stable touch points of adjacent containers being in contact with corresponding one or more substantially stable touch points. Optionally, the containers can be passed through a cooling means in a matrix or randomly grouped configuration, with at least one "inner" container and a plurality of "outer" containers. Adjacent containers can have one or more substantially stable touch points in contact with corresponding one or more substantially stable touch points. In various embodiments, inner container may cool slower than outer containers. Moreover, due to the uneven cooling rates, the temporary deformation for inner containers may be different and/or unpredictable in shape, size, and time from the temporary deformation for outer containers. Of course, none, some, or all of the temporary deformations may be the same. Containers can be conveyed or handled before, during, and after the vacuum creating step S110 by any suitable means, such as a conveyor belt.

After S110, the method 100 can proceed to any suitable step or operation. In various embodiments, the method 100 may proceed to S112.

S112 can represent conveying or handling the containers. The containers can be handled or conveyed by any suitable means. For example, the containers can be handled or conveyed by a conveyor belt. In various embodiments, the containers being conveyed can have vacuums created therein, and the containers can be temporarily deformed or distorted based on the vacuums. In various embodiments, the deformation may be confined or directed to a predetermined portion of the container, such as a smooth sidewall or a supplemental vacuum panel. From container to container, the temporary deformations may be different and/or unpredictable in shape, size, and time from the temporary deformation for outer containers. The containers having temporary deformations can be conveyed such that each container is in contact with a plurality of other containers. In various embodiments with containers having annular portions, the annular portions can provide for one or more substantially stable touch points for conveyance or handling of the containers. Moreover, one or more of the annular portions may comprise the one or more substantially stable touch points. Alternatively, one or more supplemental vacuum panels may provide for one or more substantially stable touch points.

Moreover, for a plurality of containers, the containers with temporary deformations can be conveyed or handled in any suitable grouping or order. For example, containers with temporary deformations can be conveyed in single file, with one or more substantially stable touch points of adjacent containers being in contact with corresponding one or more substantially stable touch points. Optionally, the containers with temporary deformations can be conveyed in a matrix or randomly grouped configuration, with at least one "inner" container and a plurality of "outer" containers. Adjacent containers can have one or more substantially stable touch points in contact with corresponding one or more substantially stable touch points. As noted above, the one or substantially stable touch points can be facilitated by associated annular portions or temporary supplemental vacuum panels.

As with filling, capping, and cooling, for the foregoing conveying, for containers having a moveable element in a bottom end portion, the moveable element can extend to the standing surface of the container, but not below it. Optionally, for conveying, for containers having a moveable element in a bottom end portion, the moveable element can be entirely above the standing surface. Furthermore, in various embodiments, after the conveying, the containers may be palletized, wherein the annular portions can provide support and stabilization to a plurality of palletized containers.

After S112, the method 100 can proceed to any suitable step or operation. In various embodiments, the method 100 may proceed to S114.

S114 can represent reducing, eliminating, or countering a portion of the vacuum in the container. The reduction of a portion of the vacuum in the container can also reduce or eliminate the temporary deformation or distortion of the container. In various embodiments, the container can be returned substantially to its pre-filled or pre-cooled form. The vacuums in the containers can be reduced by any suitable means. For example, for a container configured with a moveable element arranged in the bottom end thereof, the moveable element can be moved or activated to remove the vacuum. In various embodiments, for activation, the moveable element can be moved from a first position to a second position, wherein the second position is more toward the interior of the container than the first position. Additionally, some or all of the moveable element can be moved. Moreover, in various embodiments, the first position can include at least a portion of the moveable member being at an outwardly inclined position, and the second position can include at least a portion of the moveable member being at an inwardly inclined position. Movement of the moveable element to activate the container may be called inverting or inversion of the moveable element.

As noted above, the movement of the moveable element can reduce or eliminate a portion of the vacuum. In various embodiments, the portion of the vacuum removed or reduced is the entire vacuum. Optionally, the portion of the vacuum removed or reduced can mean that the entire vacuum is removed and a positive pressure is created within the container. As yet another option, the portion of the vacuum reduced or eliminated may be less than the entire vacuum. In the latter option, the remainder of the vacuum can be removed or reduced by one or more supplemental or mini vacuum panels. The supplemental vacuum panels referred to here can substantially permanently remove or reduce the remaining portion of the vacuum not removed by the moveable element.

The moveable element can be moved (or activated or inverted) by any suitable means, such as mechanical or pneumatic means. For example, a push rod can be actuated to force the moveable element from the aforementioned first position to the second position. In various embodiments, before, during, and after the reducing a portion of the vacuum in the container, the moveable element of the container is above the standing surface at all times. Optionally, the moveable element may be at or above the standing surface at all times.

After S114, the method can proceed to any suitable step or operation. FIG. 1, for example, shows the method ending at S116. However, practically speaking, after reducing the vacuum in the container (e.g., by activating a moveable element), the containers can proceed to any suitable process or operation. For example, the containers can next proceed to a testing or quality assurance operation, to a labeling operation, to a packaging operation for storage and/or shipment, and/or to a storage or staging operation.

Figure 5A:
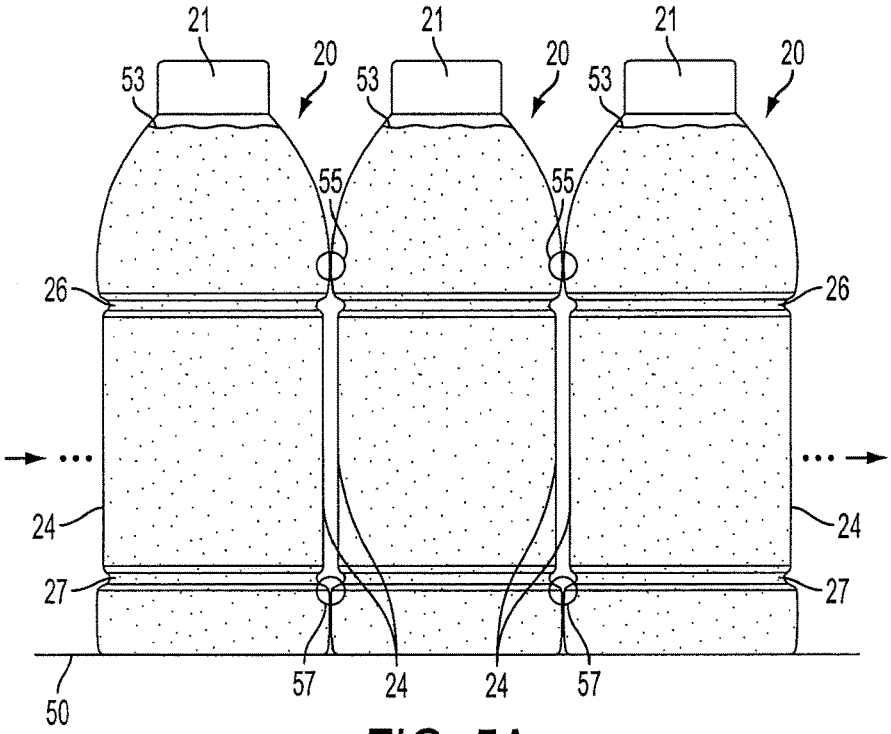
FIG. 5A is a representation of conveying or handling a plurality of filled and capped containers substantially similar to the container in FIG. 2A according to various embodiments of the present invention.
Figure 5B:
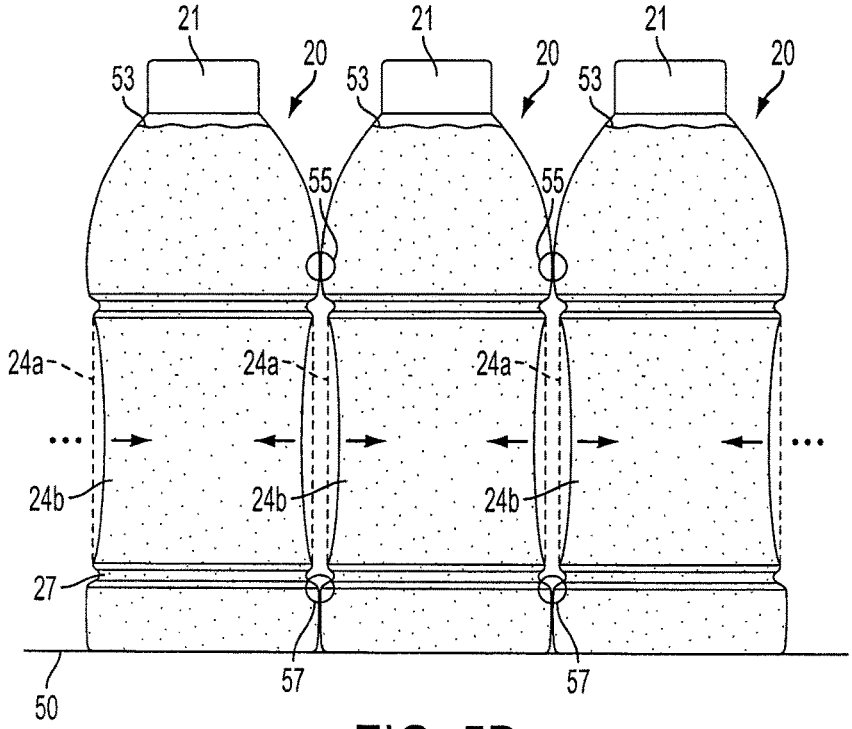
FIG. 5B is a representation of conveying or handling a plurality of filled, capped, and cooled containers substantially similar to the container in FIG. 2A according to various embodiments of the present invention.

FIGS. 5A and 5B represent conveying or handling a plurality of filled and capped containers substantially similar to the container in FIG. 2A.

FIG. 5A can represent the filled and capped containers before a vacuum is induced, for example, by cooling. The containers can be conveyed on a conveyor belt 50, for example, and FIG. 5A shows movement from left to right on the page. The three dots may represent that more containers can be arranged in either direction. Moreover, FIG. 5 (both A and B) can represent conveying in single file or in a matrix (with containers behind containers 20 being hidden from view). Item 53 can represent a fill line of the product, and the fill line can be at any suitable position, based on container configuration, hot-fill temperature, cooling temperature, cooling rate, etc. Moreover, for FIGS. 5A and 5B, the fill height 53 is substantially the same between FIGS. 5A and 5B. However, the fill heights can be different from FIGS. 5A and 5B, as well as between containers in FIG. 5B, due to deformations experienced by the containers caused by induced vacuums.

As can be seen in FIG. 5A, annular portions 26 of the containers can provide for substantially stable touch or contact points 55 for adjacent containers. Similarly, annular portions 27 can provide for substantially stable touch or contact points 57 for adjacent containers. Such stable touch points 55, 57 can prevent from contacting other, adjacent containers any temporary deformation of the smooth sidewalls 24 due to overpressure caused by elevated temperatures. As a result, the containers more reliably can be conveyed or handled. This can lead to speed improvements for conveyance and/or handling.

FIG. 5B can represent conveyance and handling of the containers 20 during and/or after creating a vacuum in the containers by cooling, for example. As can be seen, the smooth sidewalls 24 can become temporarily distorted or deformed in response to the vacuums. For example, smooth sidewalls 24 can temporarily distort from a position 24*a* to a position 24*b*. As noted above, the temporary distortion or deformation can be unpredictable in size, shape, and time. Moreover, though FIG. 5B shows all of the deformations as substantially the same for each of the containers, the deformations from container 20 to container 20 may be different in size, shape, and time.

In FIG. 5B, annular portions 26 of the containers also can provide for substantially stable touch or contact points 55 for adjacent containers having temporary deformations. Similarly, annular portions 27 can provide for substantially stable touch or contact points 57 for adjacent containers having temporary deformations. Such stable touch points 55, 57 can prevent from contacting other, adjacent containers any temporary deformation of the smooth sidewalls 24 due to vacuums created in the containers. As a result, the containers with temporary deformations more reliably can be conveyed or handled. This can lead to speed improvements for conveyance and/or handling.

Figure 6A:
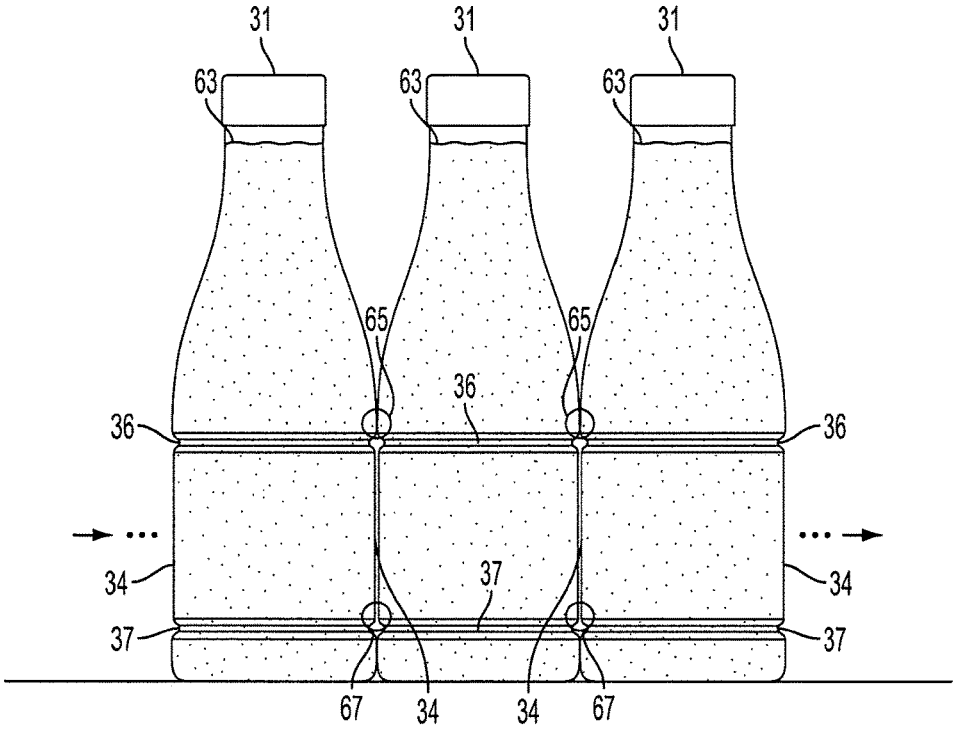
FIG. 6A is a representation of conveying or handling a plurality of filled and capped containers substantially similar to the container in FIG. 3A according to various embodiments of the present invention.
Figure 6B:
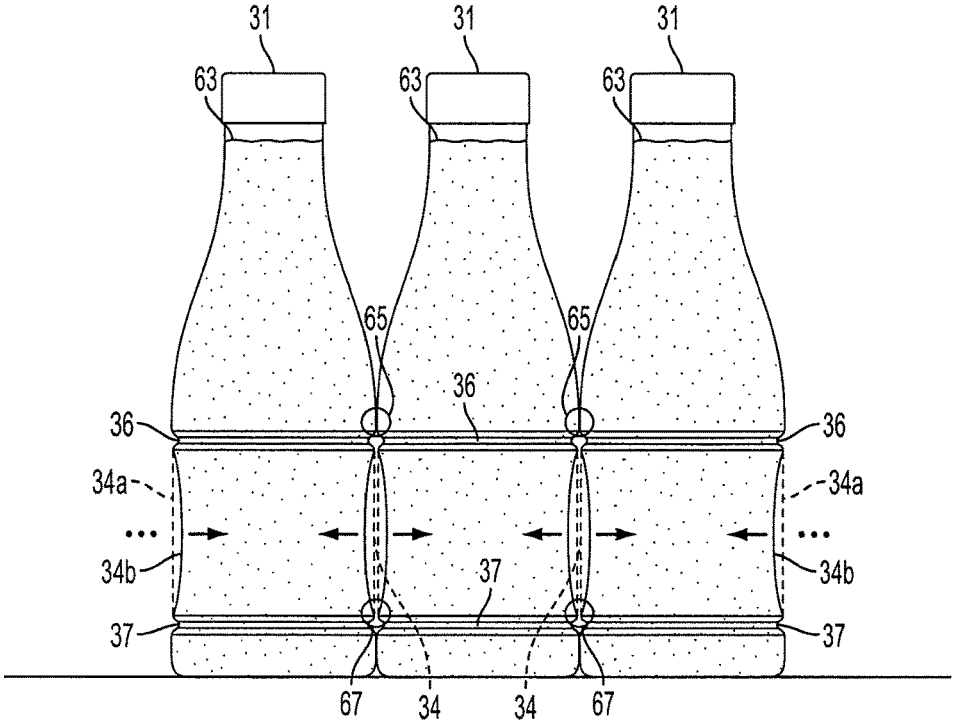
FIG. 6B is a representation of conveying or handling a plurality of filled, capped, and cooled containers substantially similar to the container in FIG. 3A according to various embodiments of the present invention.

FIGS. 6A and 6B representation conveying or handling a plurality of filled and capped containers substantially similar to the container in FIG. 3A. These containers are conveyed or handled substantially the same as described above for FIG. 5. In the representation in FIG. 6, however, the touch points may not be arranged or located at the same or similar parts of the containers 30. As with FIGS. 5A and 5B, the fill height 63 is shown as being substantially the same between FIGS. 6A and 6B. However, the fill heights can be different from FIGS. 6A and 6B, as well as between containers in FIG. 6B, due to deformations experienced by the containers caused by induced vacuums.

Figure 7:
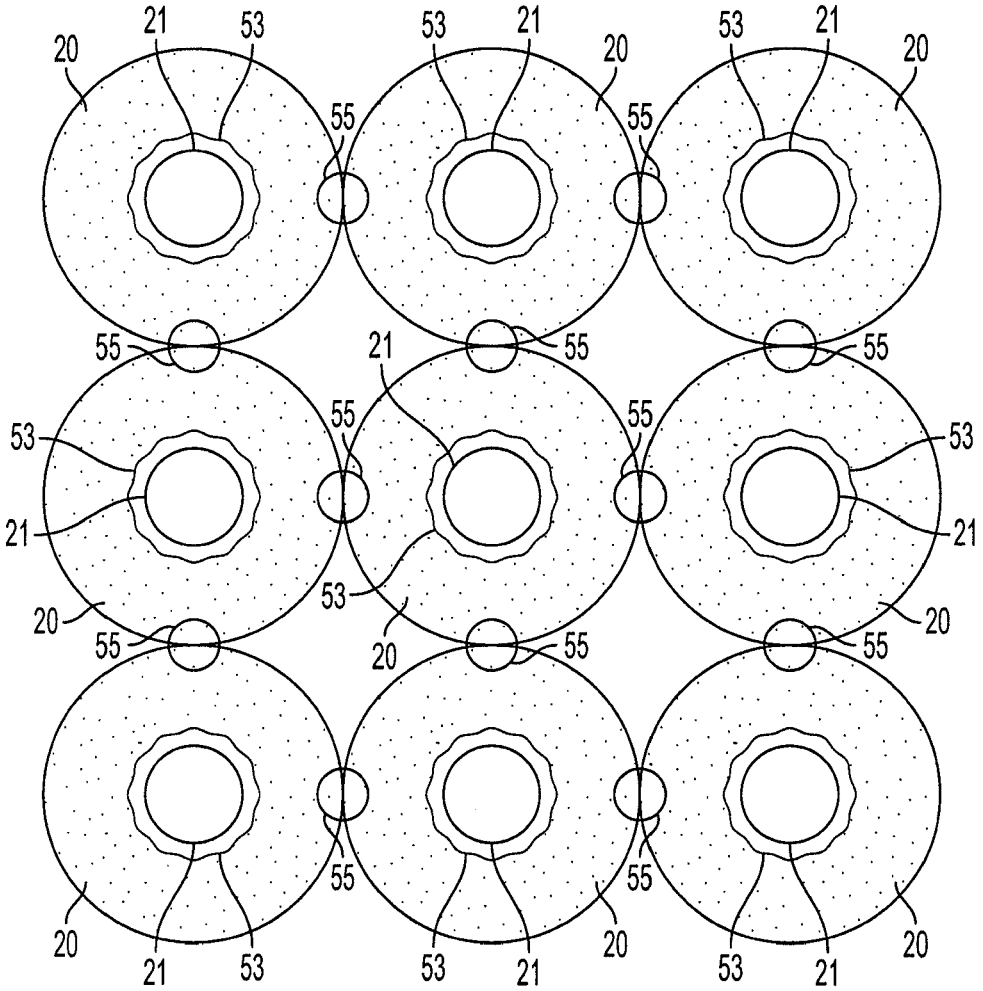
FIG. 7 shows a grouping of containers being conveyed or handled according to various embodiments of the present invention.

FIG. 7 shows a representation of a plurality of containers arranged in a matrix. The matrix can be any suitable size, with any suitable number of rows and columns, such as a one-by-one matrix, a one-by-three matrix, or a three-by-three matrix. The representation in FIG. 7 can represent a situation where the containers are filled and capped and being conveyed with a positive pressure temporary deformation, or a situation where the containers have been filled, capped, and cooled, the temporary deformations caused by vacuums in the containers 20. In either case, the containers 20 can be conveyed such that substantially stable contact or touch points 55 are maintained. In various embodiments, the substantially stable touch points 55 can be provided for by one or more annular portions. Alternatively, the one or more substantially stable touch points 55 can be provided for by one or more supplemental temporary vacuum panels.

Figure 9A:
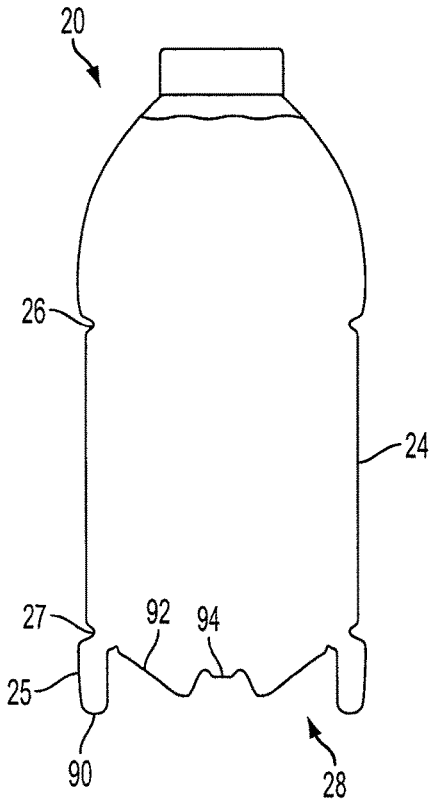
FIG. 9A is a cross section showing a base portion of a container according to various embodiments of the present invention having an un-activated moveable element.
Figure 9B:
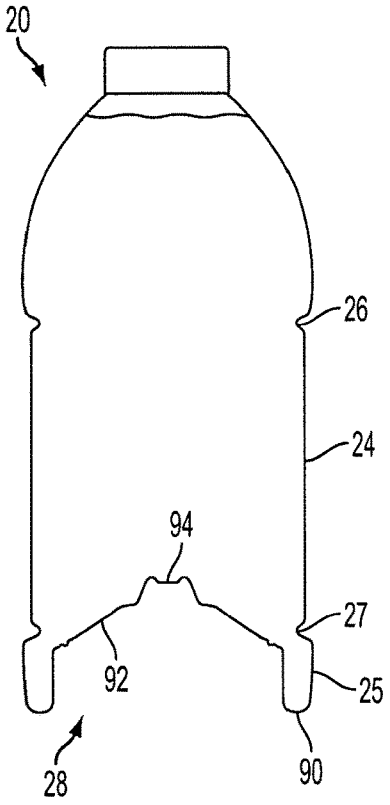
FIG. 9B is a cross section showing a base portion of a container according to various embodiments of the present invention having an activated moveable element.

Turning to FIGS. 9A and 9B, these figures show a cross section of a filled, sealed, and cooled container 20 with a moveable element 28 prior to activation (FIG. 9A) and after activation (FIG. 9B). Note that any temporary deformation of the smooth sidewall 24 prior to activation has been omitted in this figure. As can be seen from FIG. 9A, base portion 25 can include a standing surface 90, and moveable element 28 can include a moveable portion 92 and an anti-inverting portion 94. The moveable element 28 in FIG. 9A is shown entirely above standing surface 90. Optionally, moveable element 28 can be at or above standing surface 90. Here, in FIG. 9A, moveable portion 92 can be at an outwardly inclined position with respect to the inner volume of the container 20.

FIG. 9B shows moveable element 28 in an activated state. To arrive at this state, moveable portion 92 moves from the outwardly inclined position to an inwardly inclined position, which can be called inversion of the moveable portion 92. Anti-inverting portion 94 substantially retains its shape and arrangement for activation, but can move upward and inward toward the inner volume of the container. As noted above, activating the moveable element 28 can remove a portion of the vacuum. In various embodiments, removing a portion of the vacuum can return the container to its pre-filled or pre-cooled configuration.

While this invention has been described in conjunction with a number of embodiments, it is evident that many alternatives, modifications, and variations would be or are apparent to those of ordinary skill in the applicable arts. Accordingly, Applicants intend to embrace all such alternatives, modifications, equivalents and variations that are within the spirit and scope of this invention.

What is claimed is:

1. A deformable plastic container with a plurality of hoop rings, comprising:

a threaded neck portion adapted to receive a cap to sealingly enclose the container;

a body portion adjacent to the neck portion and having an overall height, the body portion including a first annular portion consisting of a first rigid, concave hoop ring, and a second annular portion consisting of a second rigid, concave hoop ring having a concave contour defined in sideview by an upper section, a lower section, and middle section between the upper section and the lower section, wherein the upper section and lower section extend radially outwardly further than the middle section, the second hoop ring having an upper edge and a lower edge, the body portion further consisting of a deformable smooth sidewall portion between said first and second hoop rings, the deformable smooth sidewall portion being circular in plan view and having a first undeformed unpressurized condition and a second deformed pressurized condition between the first and second hoop rings due to negative pressure within the container, wherein the first hoop ring and the second hoop ring are spaced apart by a distance corresponding to at least a majority of the height of the body portion to substantially confine deformation due to negative pressure within the container to the deformable smooth sidewall between the first and second hoop rings;

wherein at least one of the first annular portion and the second annular portion has a maximum diameter in plan view greater than a maximum diameter of the deformable smooth sidewall in the second deformed pressurized condition; and a base portion adjacent to the body portion that forms a stable standing surface for the container and has a bottom end thereof with a discrete moveable element configured to be selectively movable by an external force from a first, outwardly inclined stable position above the standing surface to a second, inwardly inclined stable position above the standing surface to relieve negative pressure within the container when sealingly enclosed by the cap, wherein the deformable smooth sidewall portion is coupled to and extends directly from the upper edge of the second hoop ring and the base portion is coupled to and extends directly from the lower edge of the second hoop ring, and the base portion has a maximum diameter greater than the maximum diameter of the second annular portion.

2. The container according to claim 1, wherein each of said first and second annular portions runs entirely around an entire circumference of said body portion of the container, and wherein said first and second annular portions are identical in size and shape.

3. A plurality of temporarily deformable containers arranged in a group, each said container in the group being in touching relationship with a plurality of other ones of said containers, each said container comprising:

a neck portion adapted to receive a sealing member to seal within the container a hot-filled product;

a body portion adjacent to said neck portion and having an overall height, the body portion including a first annular portion consisting of a first rigid, concave hoop ring formed therein, and a second annular portion consisting of a second rigid, concave hoop ring having a concave contour defined in sideview by an upper section, a lower section, and middle section between the upper section and the lower section, wherein the upper section and lower section extend radially outwardly further than the middle section, the second hoop ring having an upper edge and a lower edge formed therein, the body portion further consisting of a deformable smooth sidewall portion between said first and second hoop rings, the deformable smooth sidewall portion being circular in plan view and having a first undeformed unpressurized condition and a second deformed pressurized condition between the first and second hoop rings due to negative pressure within the container, wherein the first hoop ring and the second hoop ring are spaced apart by a distance corresponding to at least a majority of the height of the body portion to substantially confine deformation due to negative pressure within the container to the deformable smooth sidewall between the first and second hoop rings;

wherein at least one of said first annular portion and said second annular portion has a maximum diameter in plan view greater than a maximum diameter of the deformable smooth sidewall in the second deformed pressurized condition; and a base portion adjacent to said body portion that forms a stable standing surface for the container and has a bottom end thereof with a moveable element configured to be selectively moveable inwardly by an external force from a first, outwardly inclined stable position to a second, inwardly inclined stable position to relieve negative pressure within the container when sealingly enclosed by the sealing member, the moveable element being different than said stable standing surface and configured to be at or above said stable standing surface at all times, wherein the deformable smooth sidewall portion is coupled to and extends directly from the upper edge of the second hoop ring and the base portion has an upper part that is coupled to and extends directly from the lower edge of the second hoop ring, and the base portion has a maximum diameter greater than the maximum diameter of the second annular portion, wherein the upper part of the base portion is sized to contact one or more of said plurality of other ones of said containers when in said touching relationship with said plurality of containers.

4. The plurality of temporarily deformable containers according to claim 3, wherein, for each said container, said first and second annular portions run entirely around an entire circumference of said body portion of the container, and wherein, in a side view of each said container, each of said first and second rigid, concave hoop rings is generally C-shaped in side cross section.

5. The plurality of temporarily deformable containers according to claim 3, wherein the group of temporarily deformable containers is a single file group of said containers.

6. The plurality of temporarily deformable containers according to claim 3, wherein the plurality of temporarily deformable containers arranged in a group has at least one internal container and a plurality of external containers which surround said at least one internal container, said upper part of said base portion for each said internal container providing for a stable touch point to at least three other of said containers of the plurality, and said upper part of said base portion for each said external container providing for a stable touch point to at least two other of said containers.

7. A temporarily deformable plastic container with a plurality of hoop rings comprising:

a threaded neck portion adapted to receive a cap to sealingly enclose the container after elevated-temperature-filling the container;

a body portion adjacent to the neck portion and having an overall height, the body portion comprising a first annular portion consisting of a first rigid, concave hoop ring, and a second annular portion consisting of a second rigid, concave hoop ring having a concave contour defined in sideview by an upper section, a lower section, and middle section between the upper section and the lower section, wherein the upper section and lower section extend radially outwardly further than the middle section, the second hoop ring having an upper edge and a lower edge, the body portion further consisting of a deformable smooth sidewall portion between said first and second hoop rings, the deformable smooth sidewall portion being circular in plan view and having a first undeformed unpressurized condition and a second deformed pressurized condition between the first and second hoop rings due to negative pressure within the container, wherein the first hoop ring and the second hoop ring are spaced apart by a distance corresponding to at least a majority of the height of the body portion to substantially confine deformation due to negative pressure within the container to the deformable smooth sidewall between the first and second hoop rings;

wherein at least one of the first annular portion and the second annular portion has a maximum diameter in plan view greater than a maximum diameter of the deformable smooth sidewall in the second deformed pressurized condition; and a base portion adjacent to the body portion that forms a standing ring for the container and has a bottom end thereof with a moveable element different than the standing ring and configured to be moveable inwardly by an external force from a first, outwardly inclined stable position to a second, inwardly inclined stable position to relieve negative pressure within the container when sealingly enclosed by the sealing member, and to be at or above the standing ring at all times, wherein the deformable smooth sidewall portion is coupled to and extends directly from the upper edge of the second hoop ring and the base portion is coupled to and extends directly from the lower edge of the second hoop ring, and the base portion has a maximum diameter greater than the maximum diameter of the second annular portion.

8. The temporarily deformable plastic container of claim 7, wherein the base portion further comprises creases and an anti-inverting portion.

9. The temporarily deformable plastic container of claim 7, further comprising a part of the body portion above the first annular portion having a maximum diameter greater than the maximum diameter of the first annular portion.

10. The temporarily deformable plastic container of claim 7, wherein the maximum diameter of the first annular portion is substantially the same as the maximum diameter of the second annular portion.

11. The temporarily deformable plastic container of claim 9, wherein the maximum diameter of the base portion is substantially the same as the maximum diameter of the part of the body portion above the first annular portion.

* * * * *